US007427259B2

(12) United States Patent
Matsushita

(10) Patent No.: US 7,427,259 B2
(45) Date of Patent: Sep. 23, 2008

(54) SHEET FOLDING DEVICE, SHEET PROCESSING APPARATUS, AND IMAGE FORMING SYSTEM INCLUDING THE SHEET FOLDING DEVICE

(75) Inventor: Shingo Matsushita, Yokohama (JP)

(73) Assignee: Ricoh Co., Ltd., Tokyo (JP)

( * ) Notice: Subject to any disclaimer, the term of this patent is extended or adjusted under 35 U.S.C. 154(b) by 79 days.

(21) Appl. No.: 11/130,075

(22) Filed: May 17, 2005

(65) Prior Publication Data

US 2005/0277537 A1 Dec. 15, 2005

(30) Foreign Application Priority Data

May 17, 2004 (JP) ..... 2004-146701
Feb. 28, 2005 (JP) ..... 2005-053731

(51) Int. Cl.
*B31F 1/10* (2006.01)
*B31F 49/00* (2006.01)

(52) U.S. Cl. ..... 493/444; 493/417; 493/25; 493/29; 271/258.01

(58) Field of Classification Search ..... 493/405, 493/416, 417, 419, 442, 444, 3, 10, 25, 29; 271/258.01, 259
See application file for complete search history.

(56) References Cited

U.S. PATENT DOCUMENTS 4,935,786 A * 6/1990 Veeder ..... 399/401
5,169,376 A * 12/1992 Ries et al. ..... 493/445
5,364,332 A * 11/1994 Gray, Jr. ..... 493/23
5,377,965 A * 1/1995 Mandel et al. ..... 270/37
5,473,419 A * 12/1995 Russel et al. ..... 399/130
6,022,011 A 2/2000 Hirose
6,268,909 B1 * 7/2001 Honmochi et al. ..... 355/407
6,276,677 B1 * 8/2001 Hommochi et al. ..... 270/32
6,592,506 B1 * 7/2003 Lyga ..... 493/424
6,846,280 B2 * 1/2005 Fukasawa et al. ..... 493/424
6,939,283 B2 * 9/2005 Sparano et al. ..... 493/424
2003/0151187 A1 * 8/2003 Suzuki et al. ..... 270/1.01
2004/0046304 A1 * 3/2004 Itou et al. ..... 270/32
2005/0277537 A1 12/2005 Matsushita

FOREIGN PATENT DOCUMENTS

JP 2001-146363 5/2001

OTHER PUBLICATIONS

U.S. Appl. No. 11/273,301, filed Nov. 15, 2005, Iida et al.
Patent Abstracts of Japan, JP 2003-276937, Oct. 2, 2003.
U.S. Appl. No. 11/519,039, filed Sep. 12, 2006, Yamada et al.

* cited by examiner

*Primary Examiner*—Paul R Durand
(74) *Attorney, Agent, or Firm*—Oblon, Spivak, McClelland, Maier & Neustadt, P.C.

(57) ABSTRACT

A sheet folding device, method, and computer program product for conveying one of a sheet and a sheet bundle with pressure by a sheet conveying unit toward a sheet position adjusting unit; moving the sheet position adjusting unit to a standby position located downstream of a folding position of a folding plate in a sheet conveying direction; releasing the pressure of the sheet conveying unit; adjusting said one of a sheet and a sheet bundle to the folding position by supporting and moving said one of a sheet and a sheet bundle; putting a fold line in said one of a sheet and a sheet bundle conveyed along a sheet conveying path at the folding position; and folding said one of a sheet and a sheet bundle by pinching a portion of said one of a sheet and a sheet bundle around the fold line at a nip part.

30 Claims, 25 Drawing Sheets

| FIG. 16A |
| --- |
| FIG. 16B |

| FIG. 25A |
| --- |
| FIG. 25B |

SHEET FOLDING DEVICE, SHEET PROCESSING APPARATUS, AND IMAGE FORMING SYSTEM INCLUDING THE SHEET FOLDING DEVICE

CROSS-REFERENCE TO RELATED APPLICATIONS

This application claims priority to Japanese Patent Application No. 2004-146701 filed in the Japanese Patent Office on May 17, 2004, and Japanese Patent Application No. 2005-053731 filed in the Japanese Patent Office on Feb. 28, 2005, the entire contents of which are incorporated by reference herein.

BACKGROUND OF THE INVENTION

1. Field of the Invention

The present invention relates to a sheet folding device that folds a sheet or a sheet bundle, a sheet processing apparatus including the sheet folding device, and an image forming system including an image forming apparatus such as, a copying machine, a printer, a facsimile machine, or other similar image forming apparatuses, and the sheet processing apparatus.

2. Discussion of the Background

Conventional sheet processing devices have been widely used for stapling, punching, and folding sheets on which images are formed in the image forming apparatus. These conventional devices are generally disposed on a downstream side of an image forming apparatus such as, a copying machine, a printer, a facsimile machine, or other similar image forming apparatuses, in a sheet conveying direction. A more recent conventional sheet processing apparatus has multiple functions including center staple processing in which staple pins are stapled at at least two portions of a central portion of a sheet bundle, in addition to end-staple processing in which a staple pin is stapled at one portion near a comer portion of a sheet bundle. Generally, when performing center-staple processing, conventional center-folding processing is also performed in which a sheet bundle is folded at its stapled central portion and is simply bookbound.

The above-described conventional sheet processing apparatus uses a pair of folding rollers as folding members. A sheet bundle is folded in two by pinching the stapled central portion of the sheet bundle at a nip part between the folding rollers to bind the sheet bundle as a booklet. In this simple bookbinding operation, it is desirable to neatly align the edge of the booklet. However, if the sheet bundle is skewed before being folded at the nip part of the folding rollers, the quality of the booklet is degraded.

In another conventional sheet processing apparatus described in Published Japanese patent application No. 2001-146363, a leading edge portion of a sheet bundle is abut against a stopper, and a drive device drives the stopper to start reciprocating motions in a sheet bundle conveying direction to align the edge of the sheet bundle before performing folding processing on the sheet bundle. However, in this conventional sheet processing apparatus, time and a complicated mechanism may be necessary for performing the reciprocating motions of the stopper.

Therefore, as discovered by the present inventor, it is desirable to provide a sheet processing apparatus including a sheet folding device in which an edge of a sheet or a sheet bundle can be simply aligned and a skew of a sheet or a sheet bundle can be corrected before performing folding processing on the sheet or the sheet bundle.

SUMMARY OF THE INVENTION

To address the deficiencies of the previously described conventional devices, the present invention is directed to a sheet folding device includes a folding plate configured to put a fold line in one of a sheet and a sheet bundle conveyed along a sheet conveying path at a folding position, and folding rollers configured to fold the one of a sheet and a sheet bundle by pinching a portion of the one of a sheet and a sheet bundle around the fold line at a nip part between the folding rollers. The folding plate is configured to advance toward the nip part in a direction substantially perpendicular to a sheet conveying direction. The sheet folding device further includes a sheet position adjusting unit configured to support and move the one of a sheet and a sheet bundle and to adjust the one of a sheet and a sheet bundle to the folding position of the folding plate, a sheet conveying unit configured to convey the one of a sheet and a sheet bundle with pressure toward the sheet position adjusting unit, and a drive device configured to move the sheet position adjusting unit to a standby position located downstream of the folding position of the folding plate in the sheet conveying direction, and to move the sheet position adjusting unit after the pressure of the sheet conveying unit is released.

According to another aspect of the present invention, a sheet processing apparatus includes the above-described sheet folding device that folds one of a sheet and a sheet bundle, and at least one of a sheet stapling device configured to staple the sheet bundle, a sheet sorting device configured to sort sheets, and a sheet punching device configured to punch holes in the sheet.

According to yet another aspect of the present invention, an image forming system includes an image forming device, and the above-described sheet folding device.

The invention is also directed to corresponding methods and computer program products.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
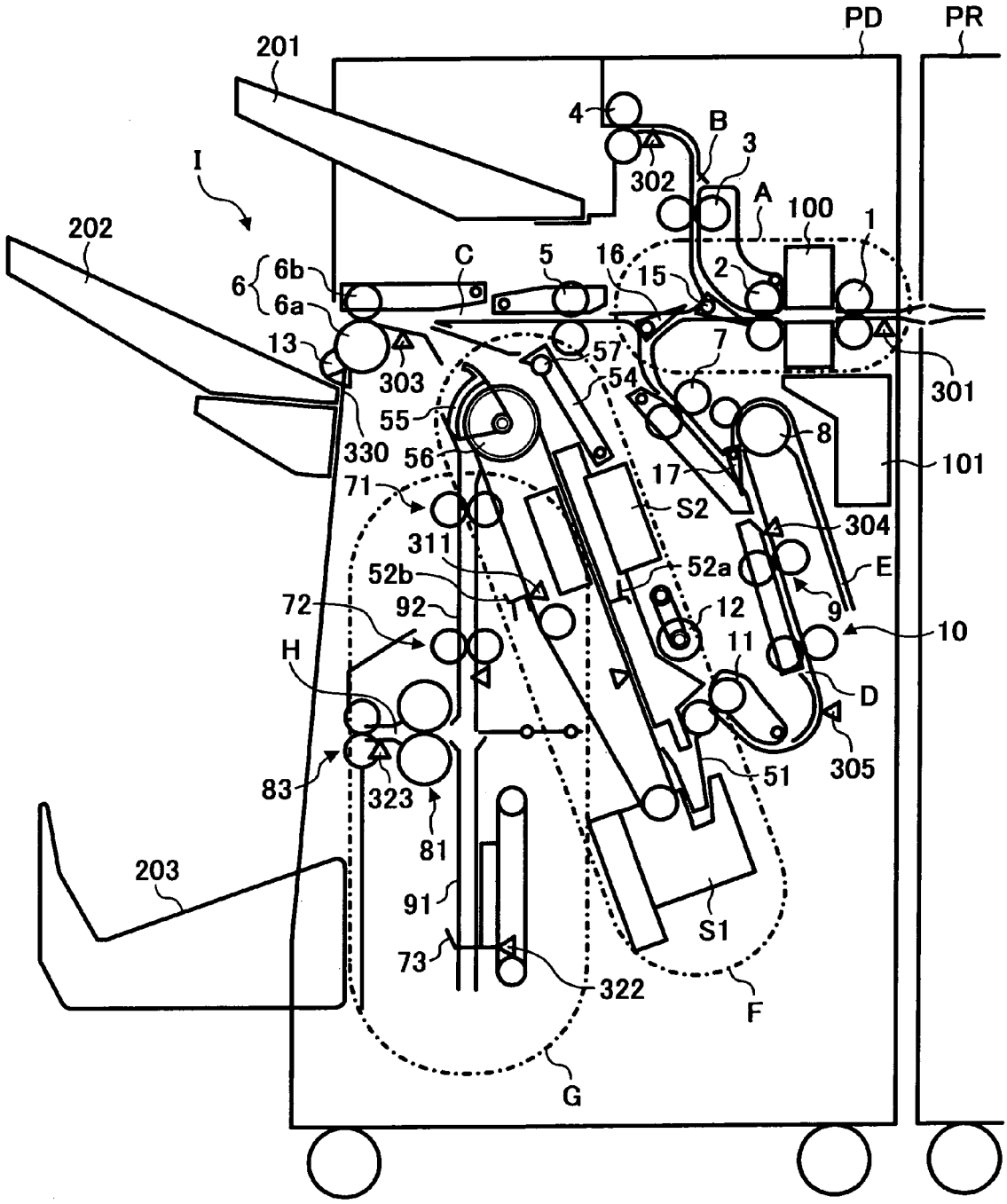
FIG. 1 is a schematic side elevational view of an image forming system including a sheet post-processing apparatus and an image forming apparatus according to an example embodiment of the present invention.

Example embodiments of the present invention are described with reference to the drawings, wherein like reference numerals designate identical or corresponding parts throughout the views.

FIG. 1 is a schematic side elevational view illustrating an image forming system including a sheet post-processing apparatus acting as a sheet processing apparatus and an image forming apparatus. With reference to FIG. 1, a sheet post-processing apparatus PD is attached to a side portion of an image forming apparatus PR. A recording medium such as a sheet (hereafter referred to as a "sheet") discharged from the image forming apparatus PR is directed to the sheet post-processing apparatus PD. Then, the sheet is conveyed through a sheet conveying path A in which a sheet punching device 100 is provided. The sheet punching device 100 punches a hole or holes in the sheet. Subsequently, the sheet is switched to be directed to one of a sheet conveying path B leading to an upper tray 201, a sheet conveying path C leading to a shift tray 202, and a sheet conveying path D leading to a sheet stapling device F by branching pawls 15 and 16.

A sheet, which has been conveyed through the sheet conveying path A and the sheet conveying path D, is directed to the sheet stapling device F and is subjected to alignment and staple processing. The stapled sheet bundle is switched to be conveyed to one of the sheet conveying path C leading to the shift tray 202 and a sheet folding device G by a branching guide plate 54 and a movable guide 55. The sheet bundle subjected to folding processing in the sheet folding device G is directed to a lower tray 203 through a sheet conveying path H.

A branching pawl 17 is disposed in the sheet conveying path D. The branching pawl 17 is held in a position illustrated in FIG. 1 by a low loading spring (not shown). After a trailing edge of a sheet passes the branching pawl 17, at least conveyor rollers 9 out of the conveyor rollers 9, conveyor rollers 10, and staple sheet discharging rollers 11, are rotated in a reverse direction, thereby guiding the trailing edge of the sheet toward a sheet stacking section E by pre-stack rollers 8. The sheet stacking section E is configured such that the sheet stacked therein can be superimposed on a succeeding sheet and conveyed together. By repeating this operation, at least two sheets superimposed on each other can be conveyed together.

In the sheet conveying path A located on an upstream side of the sheet conveying paths B, C, and D in the sheet conveying direction, an entrance sensor 301 that detects a sheet conveyed from the image forming apparatus PR is provided. Further, entrance rollers 1, the sheet punching device 100, a punch residue receiving hopper 101, conveyor rollers 2, and the branching pawls 15 and 16 are provided downstream of the entrance sensor 301 in the sheet conveying direction in the sheet conveying path A. The branching pawls 15 and 16 are held in positions illustrated in FIG. 1 by springs (not shown), respectively. By turning on respective solenoids (not shown), the branching pawl 15 rotates upward and the branching pawl 16 rotates downward, thereby switching a sheet to be conveyed to the sheet conveying paths B, C, and D.

When directing a sheet to the sheet conveying path B, the branching pawl 15 is held in a position illustrated in FIG. 1 and the solenoid is turned off. When directing a sheet to the sheet conveying path C, the respective solenoids are turned on, thereby rotating the branching pawl 15 upward and rotating the branching pawl 16 downward. When directing a sheet to the sheet conveying path D, the branching pawl 16 is held in a position illustrated in FIG. 1 and the solenoid is turned off, and the branching pawl 15 is rotated upward by turning on the solenoid.

The sheet post-processing apparatus PD performs various types of processing on a sheet, such as punching by using the sheet punching device 100, sheet alignment and end stapling by using jogger fences 53 and an end-stapling stapler SI, sheet alignment and center stapling by using the jogger fences 53 and center-stapling staplers S2, sheet sorting by using the shift tray 202, and center folding by using a folding plate 74 and folding rollers 81.

<Shift Tray Section>

Figure 2:
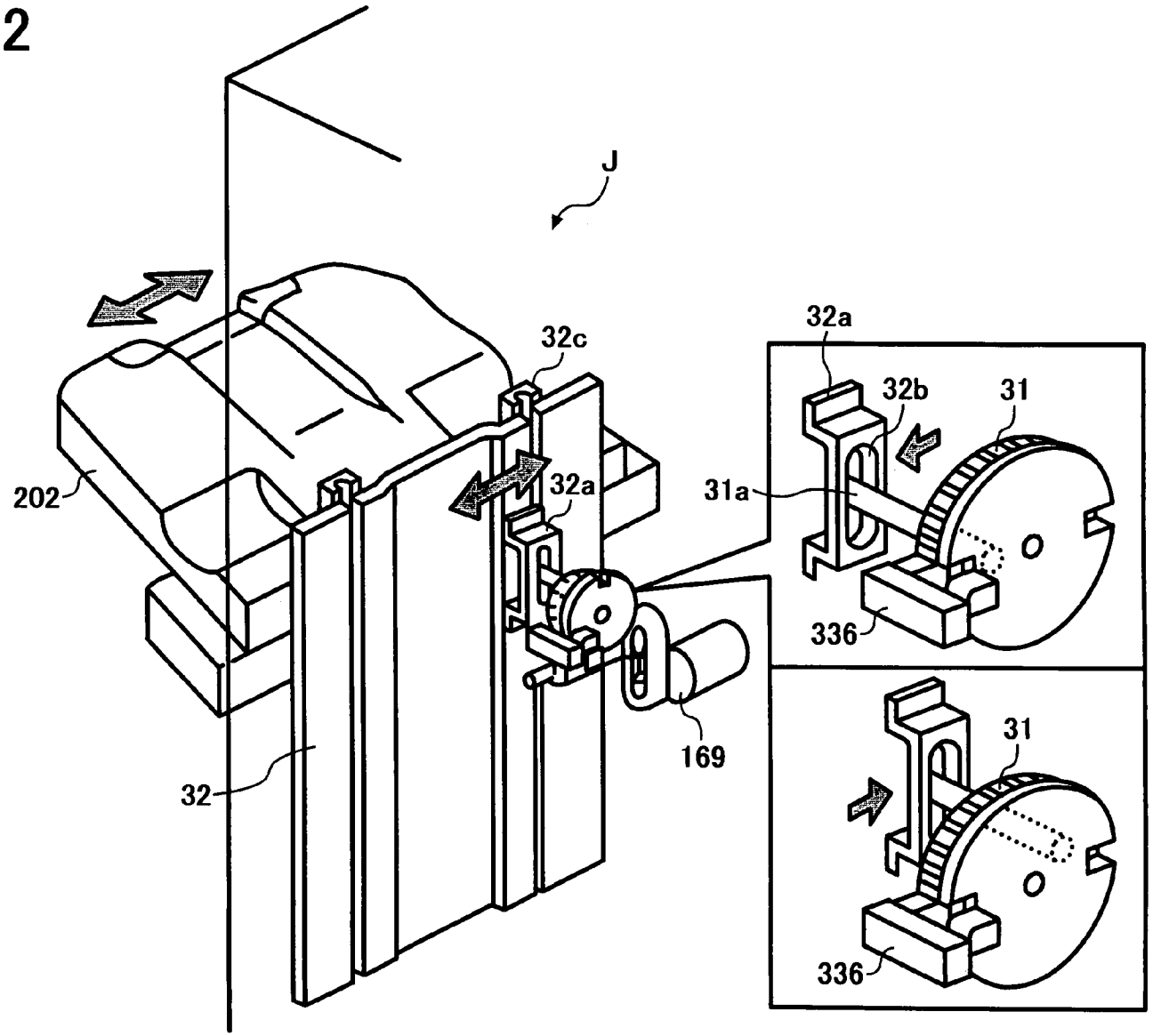
FIG. 2 is an enlarged perspective view of a shift mechanism of the sheet post-processing apparatus of FIG. 1.
Figure 3:
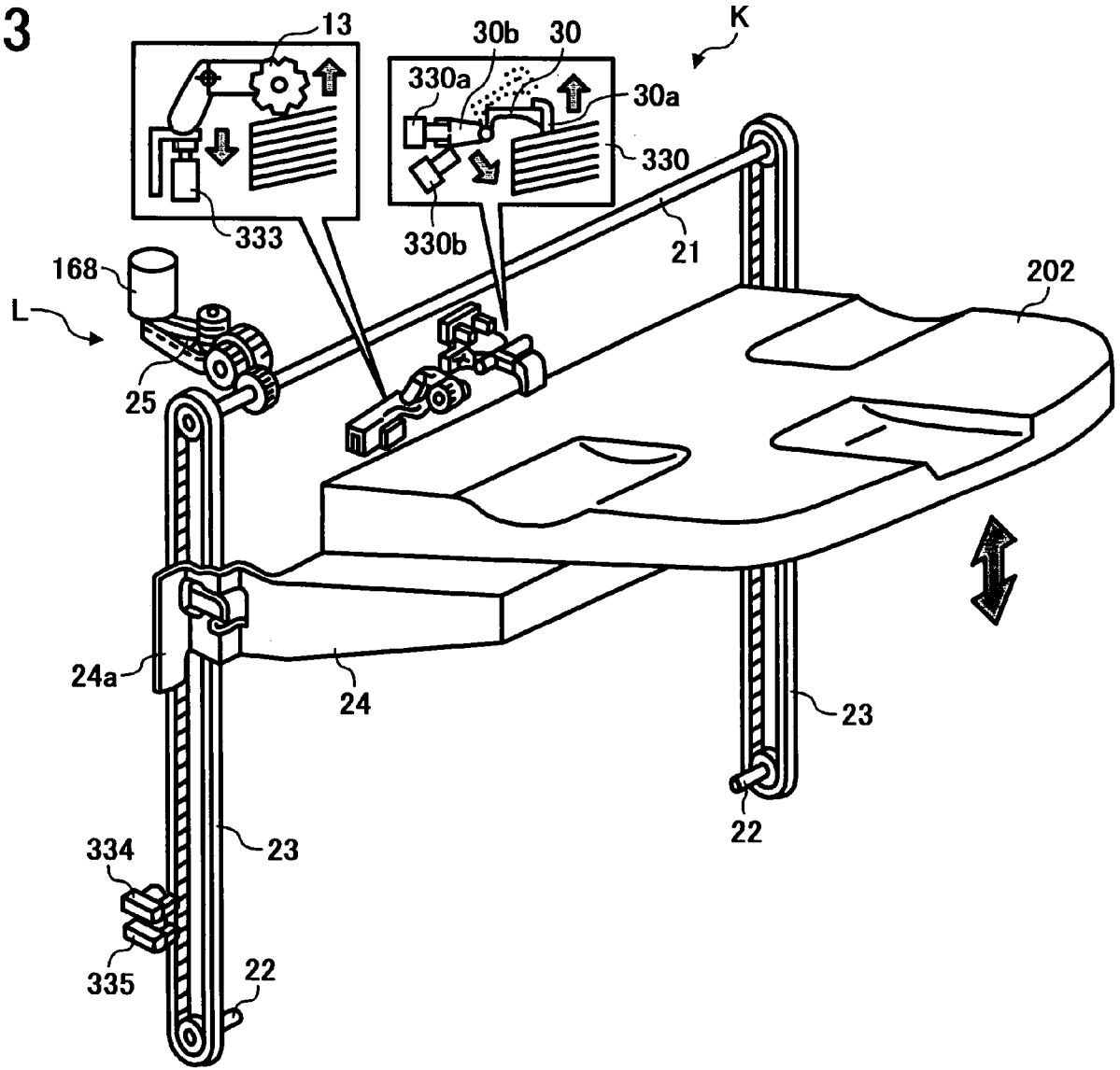
FIG. 3 is an enlarged perspective view of a shift tray raising and lowering mechanism of the sheet post-processing apparatus of FIG. 1.

A shift tray sheet discharging section I of the sheet post-processing apparatus PD includes shift sheet discharging rollers 6, a return roller 13, a sheet surface detecting sensor 330, the shift tray 202, a shift mechanism J illustrated in FIG. 2, and a shift tray raising and lowering mechanism K illustrated in FIG. 3. FIG. 2 is an enlarged perspective view of the shift mechanism J. FIG. 3 is an enlarged perspective view of the shift tray raising and lowering mechanism K.

In FIGS. 1 and 3, a reference numeral 13 indicates a return roller made of a sponge that contacts a sheet discharged by the shift sheet discharging rollers 6 and strikes a trailing edge of the sheet against an end fence 32 illustrated in FIG. 2 for alignment. The return roller 13 is rotated by the rotational force of the shift sheet discharging rollers 6. As illustrated in FIG. 3, a tray raise limit switch 333 is provided in the vicinity of the return roller 13. When the raised shift tray 202 pushes up the return roller 13, the tray raise limit switch 333 becomes on and a tray raising and lowering motor 168 stops. The shift tray 202 is prevented from being overrun due to this mechanism. Further, as illustrated in FIG. 1, the sheet surface detecting sensor 330 is provided in the vicinity of the return roller 13 to detect a sheet surface position of a sheet or a sheet bundle discharged on the shift tray 202.

As illustrated in FIG. 3, the sheet surface detecting sensor 330 includes a sheet surface detecting lever 30, a sheet surface detecting sensor (for a staple mode) 330*a*, and a sheet surface detecting sensor (for a non-staple mode) 330*b*. The sheet surface detecting lever 30 is configured to rotate about its shaft portion, and includes a contact portion 30*a* that contacts an upper surface of a trailing edge of a sheet stacked on the shift tray 202 and a sector-shaped interrupting portion 30*b*. The sheet surface detecting sensor 330*a* disposed at an upper side, is mainly used for a stapled sheet bundle discharging control, and the sheet surface detecting sensor 330*b* is mainly used for a shifted sheet discharging control.

In this embodiment, the sheet surface detecting sensor 330*a* and the sheet surface detecting sensor 330*b* become on when the interrupting portion 30*b* interrupts them. When the shift tray 202 is raised and the contact portion 30*a* of the sheet surface detecting lever 30 is rotated upward, the sheet surface detecting sensor 330*a* becomes off. When the contact portion 30*a* of the sheet surface detecting lever 30 is further rotated upward, the sheet surface detecting sensor 330*b* becomes on. When the sheet surface detecting sensors 330*a* and 330*b* detect that a height of sheets stacked on the shift tray 202 reaches a predetermined value, the tray raising and lowering motor 168 drives the shift tray 202 to be lowered by a predetermined distance. By this arrangement, a position of a surface of a sheet stacked on the shift tray 202 is substantially maintained.

<Shift Tray Raising and Lowering Mechanism>

Next, the shift tray raising and lowering mechanism K for the shift tray 202 is described. As illustrated in FIG. 3, the shift tray 202 is raised and lowered by driving a drive shaft 21 by a drive unit L. A pair of timing belts 23 are provided in parallel to each other on both sides of the shift tray 202 in a direction perpendicular to a sheet discharging direction. Each of the timing belts 23 is spanned around the drive shaft 21 and a driven shaft 22 via timing pulleys with a tension. A side plate 24, which supports the shift tray 202, is fixed to the timing belts 23. In this configuration, a unit including the shift tray 202 is suspended by the timing belts 23 such that the unit including the shift tray 202 can be raised and lowered.

As illustrated in FIG. 3, the drive unit L includes the tray raising and lowering motor 168 and a worm gear 25. A drive force produced by the tray raising and lowering motor 168 acting as a drive source is transmitted to a last gear of a gear train fixed onto the drive shaft 21 via the worm gear 25, and thereby the shift tray 202 moves up and down. The tray raising and lowering motor 168 is configured to rotate in forward and reverse directions. Because a drive force transmitting system is connected to the drive shaft 21 via the worm gear 25, the shift tray 202 can be held at a constant position. Further, due to such a gear configuration, an unexpected fall accident of the shift tray 202 can be prevented.

An interrupting plate 24*a* is integrally formed with the side plate 24 which supports the shift tray 202. A full detecting sensor 334 and a lower limit sensor 335 are disposed below the interrupting plate 24*a*. The full detecting sensor 334 detects the full load of stacked sheets, and the lower limit sensor 335 detects a lower limit position of the shift tray 202. The full detecting sensor 334 and lower limit sensor 335 are turned on and off by the interrupting plate 24*a*. For example, each of the full detecting sensor 334 and the lower limit sensor 335 is formed from a photosensor. The full detecting sensor 334 and the lower limit sensor 335 become on when they are interrupted by the interrupting plate 24*a*. In FIG. 3, an illustration of the shift sheet discharging rollers 6 is omitted.

As illustrated in FIG. 2, the shift mechanism J for the shift tray 202 includes a shift motor 169 and a shift cam 31. By rotating the shift cam 31 by the shift motor 169, the shift tray 202 reciprocates in a direction perpendicular to a sheet discharging direction. A pin 31 a stands on the shift cam 31 at a position away from a center of a rotation shaft of the shift cam 31. The other end portion of the pin 31*a*, which is located on a side opposite from the one end portion in contact with the shift cam 31, fits loosely into an oblong hole 32*b* of an engaging member 32*a* of the end fence 32. The engaging member 32*a* is fixed on a back surface (a surface located on a side opposite from the shift tray 202) of the end fence 32, and reciprocates in the direction perpendicular to the sheet discharging direction according to a turn position of the pin 31*a* on the shift cam 31. In accordance with the reciprocating motions of the engaging member 32*a*, the shift tray 202 moves in the direction perpendicular to the sheet discharging direction. In FIG. 1, the shift tray 202 stops at a position on a front side and at a position on a rear side relative to the sheet surface of FIG. 1. The stop of the shift tray 202 is controlled by detecting a cut-away portion of the shift cam 31 by a shift sensor 336 and by turning on and off the shift motor 169 based on a detection signal output from the shift sensor 336.

Two protruded streaks 32*c* for guiding the shift tray 202 are provided on a front surface of the end fence 32. The rear end portion of the shift tray 202 fits loosely into the protruded streaks 32*c* such that the shift tray 202 can move up and down. By this arrangement, the shift tray 202 is supported by the end fence 32 such that the shift tray 202 can move up and down and reciprocate in the direction perpendicular to the sheet discharging direction. The end fence 32 is configured to guide and align the trailing edge of sheets stacked on the shift tray 202.

<Sheet Discharging Section>

Figure 4:
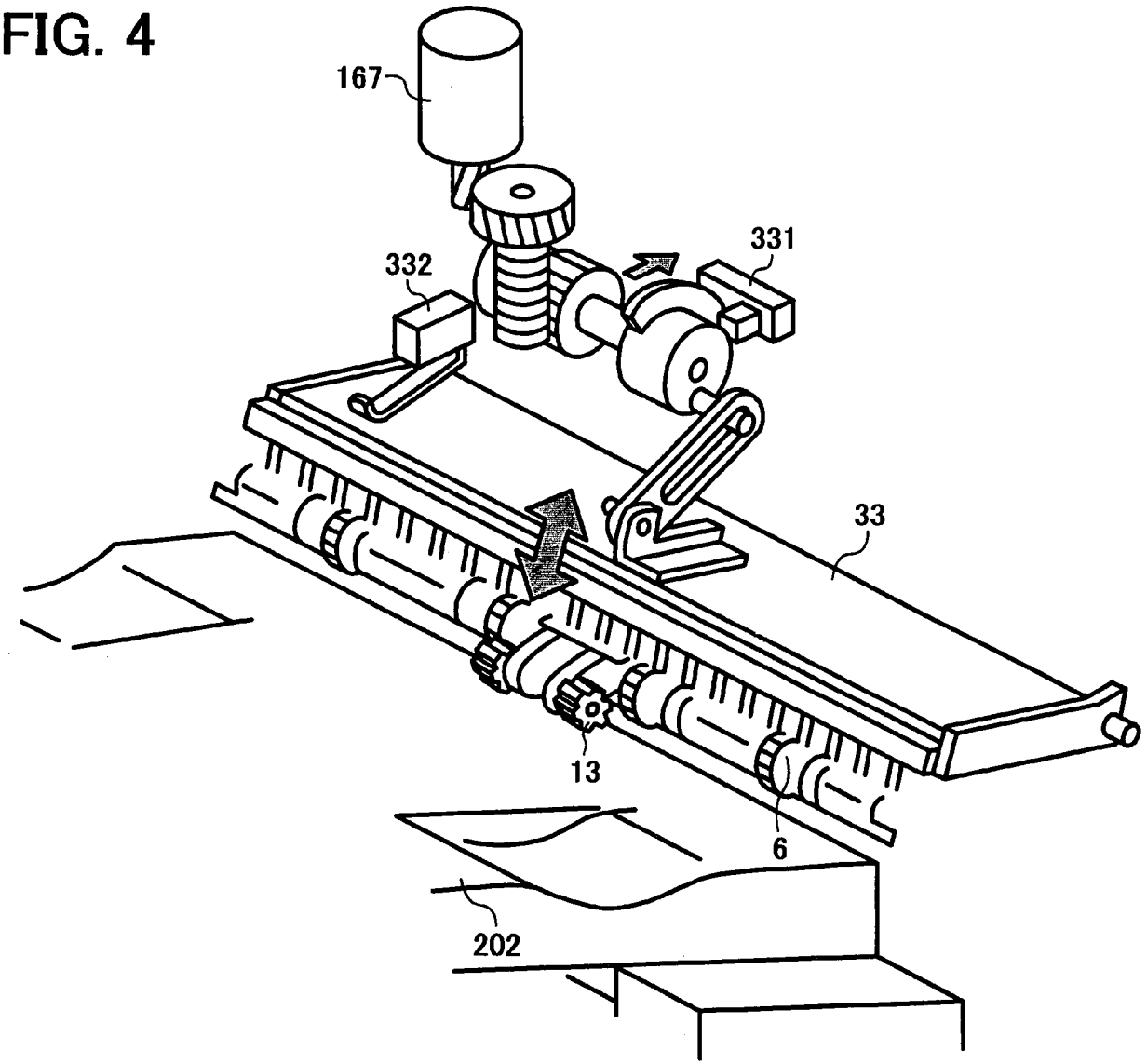
FIG. 4 is a perspective view of a sheet discharging section for a shift tray of the sheet post-processing apparatus of FIG. 1.

FIG. 4 is a perspective view of the shift tray sheet discharging section I that discharges sheets to the shift tray 202.

With reference to FIGS. 1 and 4, the shift discharging rollers 6 include a drive roller 6*a* and a driven roller 6*b*. The driven roller 6*b* is rotatably supported by a free end portion of an open/close guide plate 33. One end portion of the open/close guide plate 33 located on an upstream side in the sheet discharging direction is supported such that the open/close guide plate 33 can swing up and down. The driven roller 6*b* contacts the drive roller 6*a* by its own weight or a biasing force of the open/close guide plate 33. A sheet passes through a nip part between the drive roller 6*a* and the driven roller 6*b* and is discharged to the shift tray 202. When a stapled sheet bundle is discharged, the open/close guide plate 33 is lifted and returned at predetermined timing by a guide plate open/close motor 167. Such timing is determined based on a detection signal of a shift sheet discharging sensor 303. Further, a stop position of the open/close guide plate 33 is determined based on a detection signal of a guide plate open/close sensor 331. The drive of the guide plate open/close motor 167 is controlled by on and off operations of a guide plate open/close limit switch 332.

<Configuration of a Sheet Stapling Device>

Figure 5:
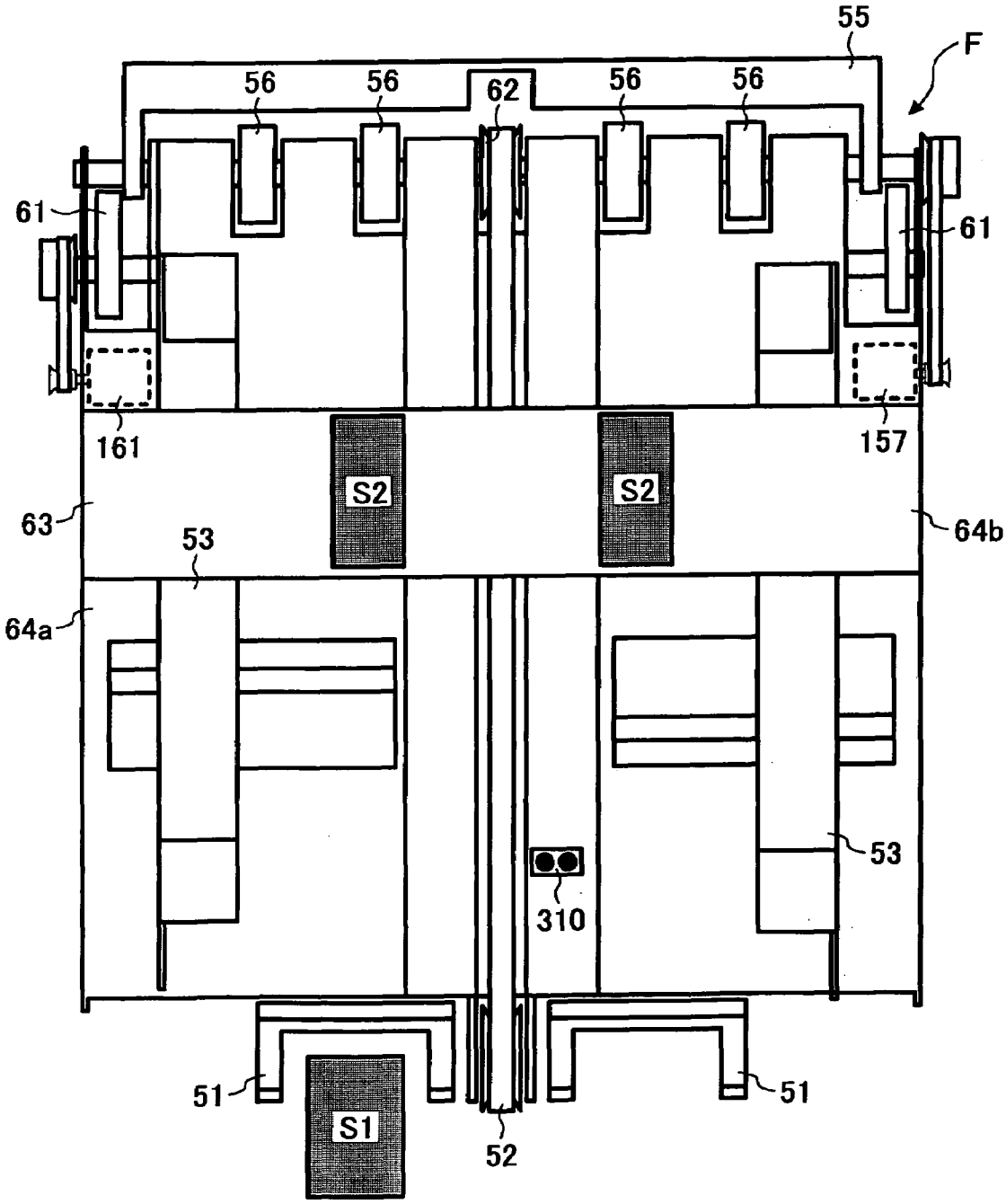
FIG. 5 is a top view of a sheet stapling device of the sheet post-processing apparatus of FIG. 1, seen from a direction perpendicular to a sheet stacking surface of a staple processing tray.
Figure 6:
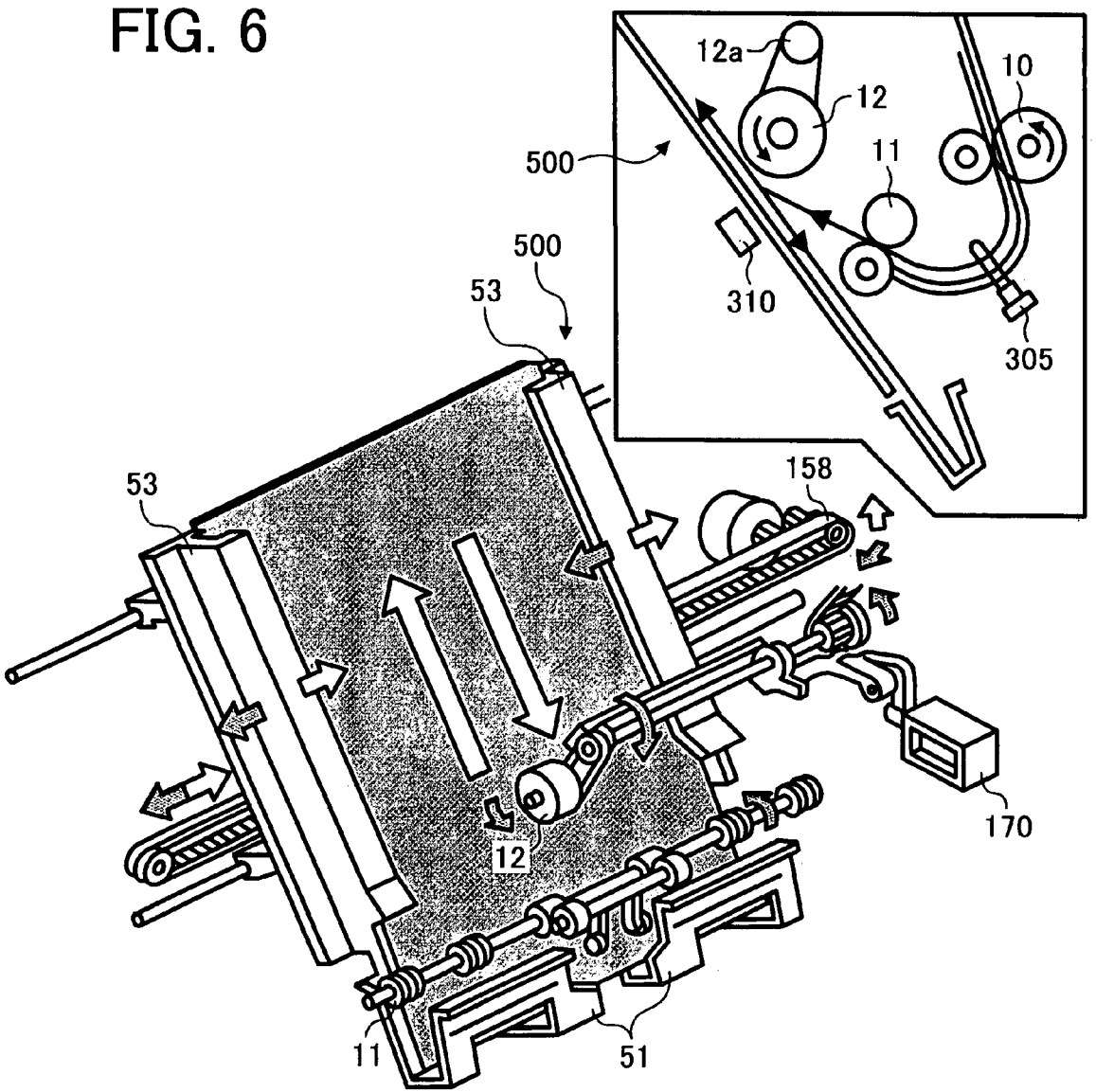
FIG. 6 is a perspective view of the staple processing tray and a drive mechanism of the sheet stapling device.
Figure 7:
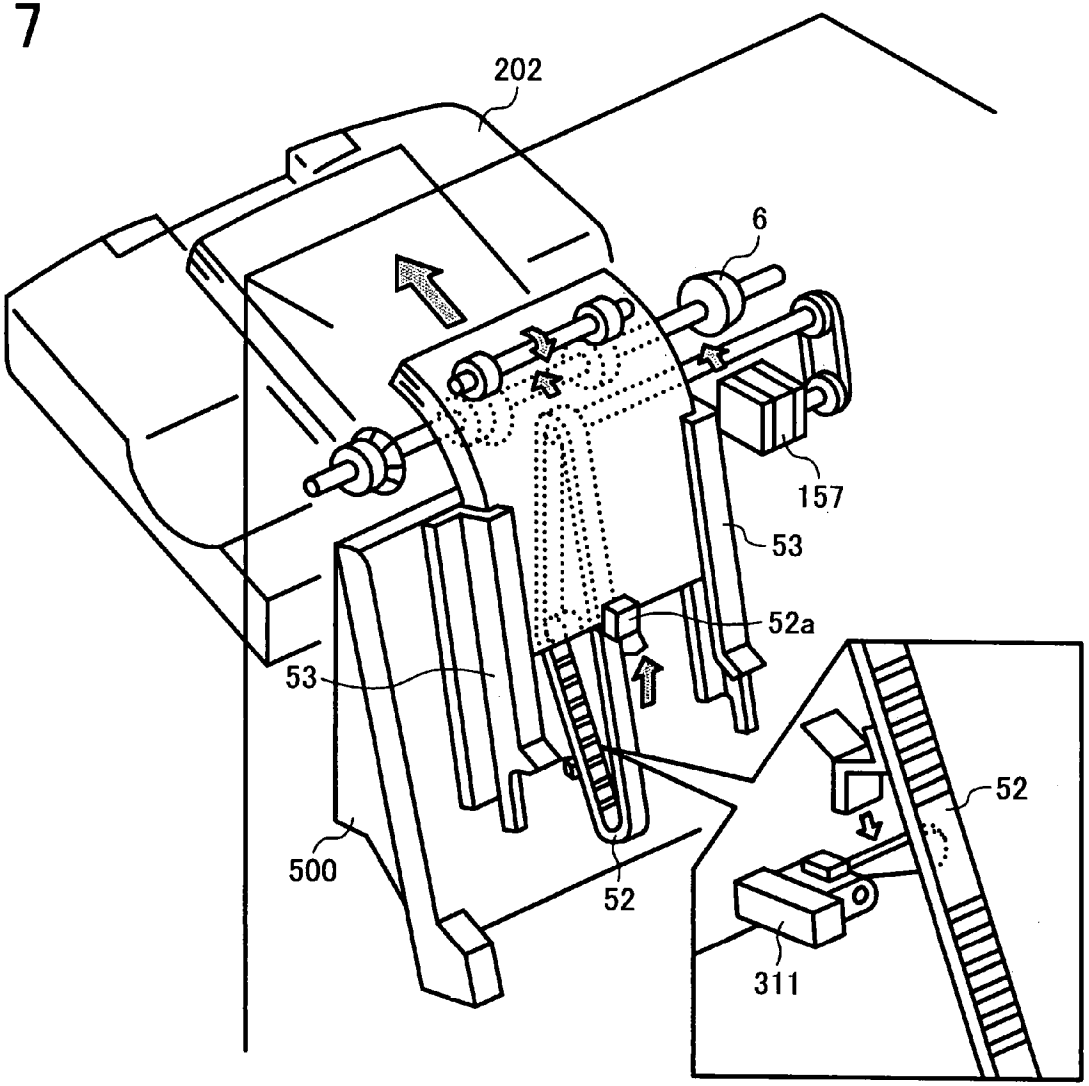
FIG. 7 is a perspective view of a sheet discharging mechanism of the sheet stapling device.

Next, a configuration of the sheet stapling device F that performs staple processing is described. FIG. 5 is a top view of the sheet stapling device F seen from a direction perpendicular to a sheet stacking surface of a staple processing tray 500. FIG. 6 is a perspective view of the staple processing tray 500 and a drive mechanism. FIG. 7 is a perspective view of a sheet discharging mechanism that discharges a stapled sheet bundle. As illustrated in FIG. 6, the sheet directed to the sheet stapling device F by a pair of conveyor rollers 11, is stacked on the staple processing tray 500 sheet by sheet. At this time, the sheet is aligned in a lengthwise direction (i.e., a sheet conveying direction) by a hitting roller 12. Further, the sheet is aligned in a widthwise direction (i.e., a direction perpendicular to a sheet conveying direction) by being jogged with the jogger fences 53. At an interruption of job during a period from when a last sheet of a sheet bundle is stacked on the staple processing tray 500 to when a first sheet of a subsequent sheet bundle is stacked on the staple processing tray 500, the end-stapling stapler S1 is driven based on a staple signal transmitted from a control device 350 (shown in FIG. 16), thereby performing end-staple processing. The stapled sheet bundle is conveyed to the shift sheet discharging rollers 6 by a release belt 52 on which a hook-shaped release claw 52*a* (shown in FIG. 7) is protrudingly provided. Subsequently, the stapled sheet bundle is discharged to the shift tray 202 set at its sheet receiving position.

<Sheet Discharging Mechanism>

As illustrated in FIG. 7, the home position of the release belt 52 is detected by a release belt home position sensor 311, and the release belt home position sensor 311 is turned on and off by the release claw 52*a* provided on an outer circumferential surface of the release belt 52. As illustrated in FIG. 1, another release claw 52*b* is provided on the outer circumferential surface of the release belt 52 at a position opposite to the release claw 52*a*. The release claws 52*a* and 52*b* alternately convey a sheet bundle stacked on the staple processing tray 500. If necessary, the release belt 52 is rotated in a reverse direction to align the leading edge of the sheet bundle in the sheet conveying direction, which is stacked on the staple processing tray 500, by back surfaces of the release claws 52*a* and 52*b* which are in a standby condition to convey the sheet bundle. Thus, the release claws 52*a* and 52*b* also act as an aligning device for aligning a sheet bundle in a sheet conveying direction.

As illustrated in FIG. 5, the release belt 52 and a drive pulley 62 are disposed on a drive shaft for driving the release belt 52 by a release motor 157 at the center of the drive shaft in its axial direction which corresponds to the center of a span between the jogger fences 53. Further, release rollers 56 are disposed on the drive shaft in a symmetric state relative to the drive pulley 62. The circumferential speed of the release roller 56 is set to be higher than that of the release belt 52.

<Staple Processing Mechanism>

As illustrated in FIG. 6, the hitting roller 12 swings about a supporting point 12*a* by an operation of a solenoid 170. The hitting roller 12 swings to contact a surface of a sheet conveyed to the staple processing tray 500. After contacting, the hitting roller 12 rotates to move the sheet toward an end fence 51 provided at the lower part of the staple processing tray 500, so that the trailing edge of the sheet in the sheet conveying direction is made to abut against the end fence 51 to be aligned with other sheets in the sheet conveying direction. The jogger fences 53 are driven to reciprocate in the sheet width direction by a jogger motor 158 via a timing belt. The jogger motor 158 rotates in forward and reverse directions.

Figure 8:
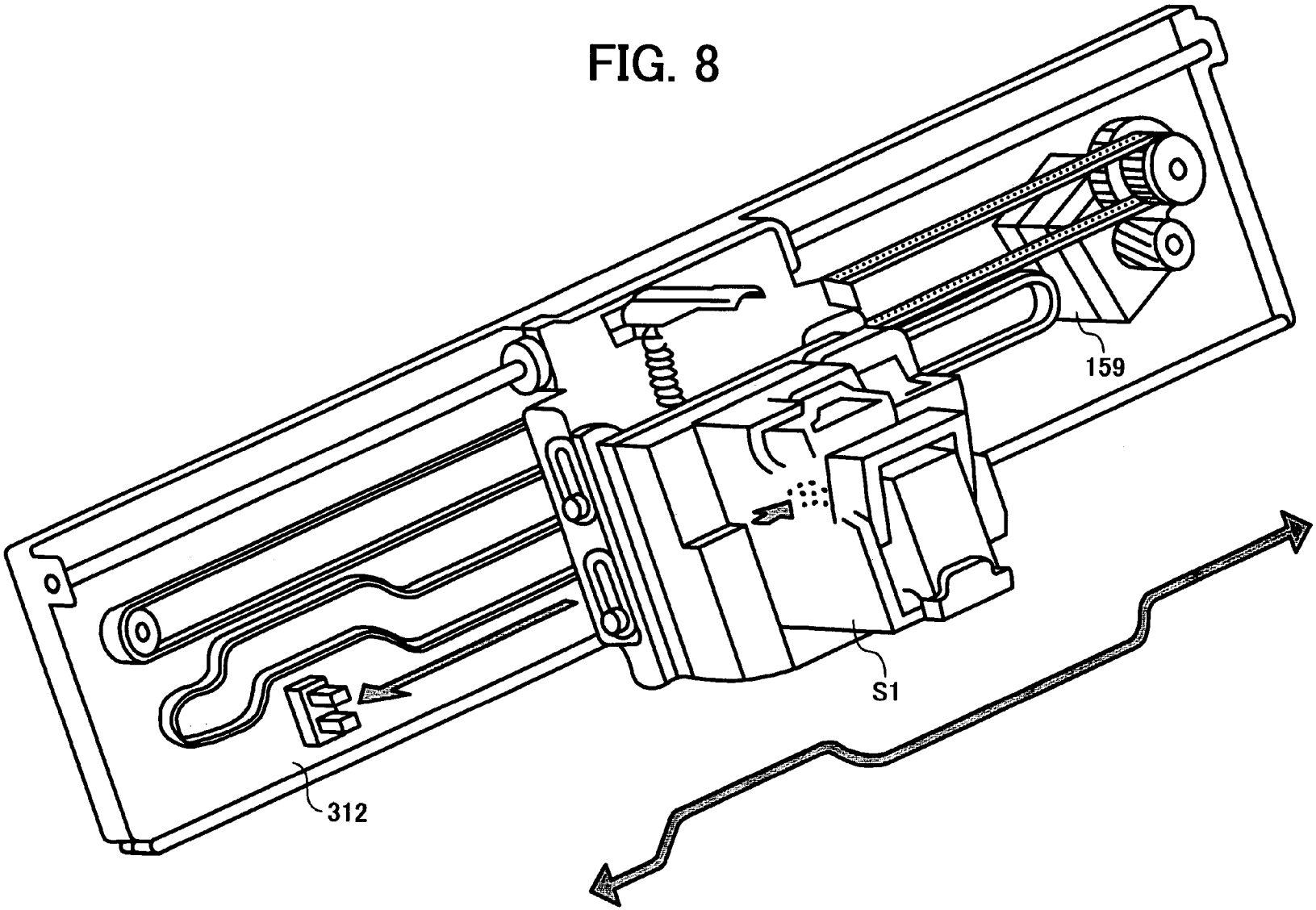
FIG. 8 is a perspective view of an end-stapling stapler and a stapler moving mechanism of the sheet stapling device.
Figure 9:
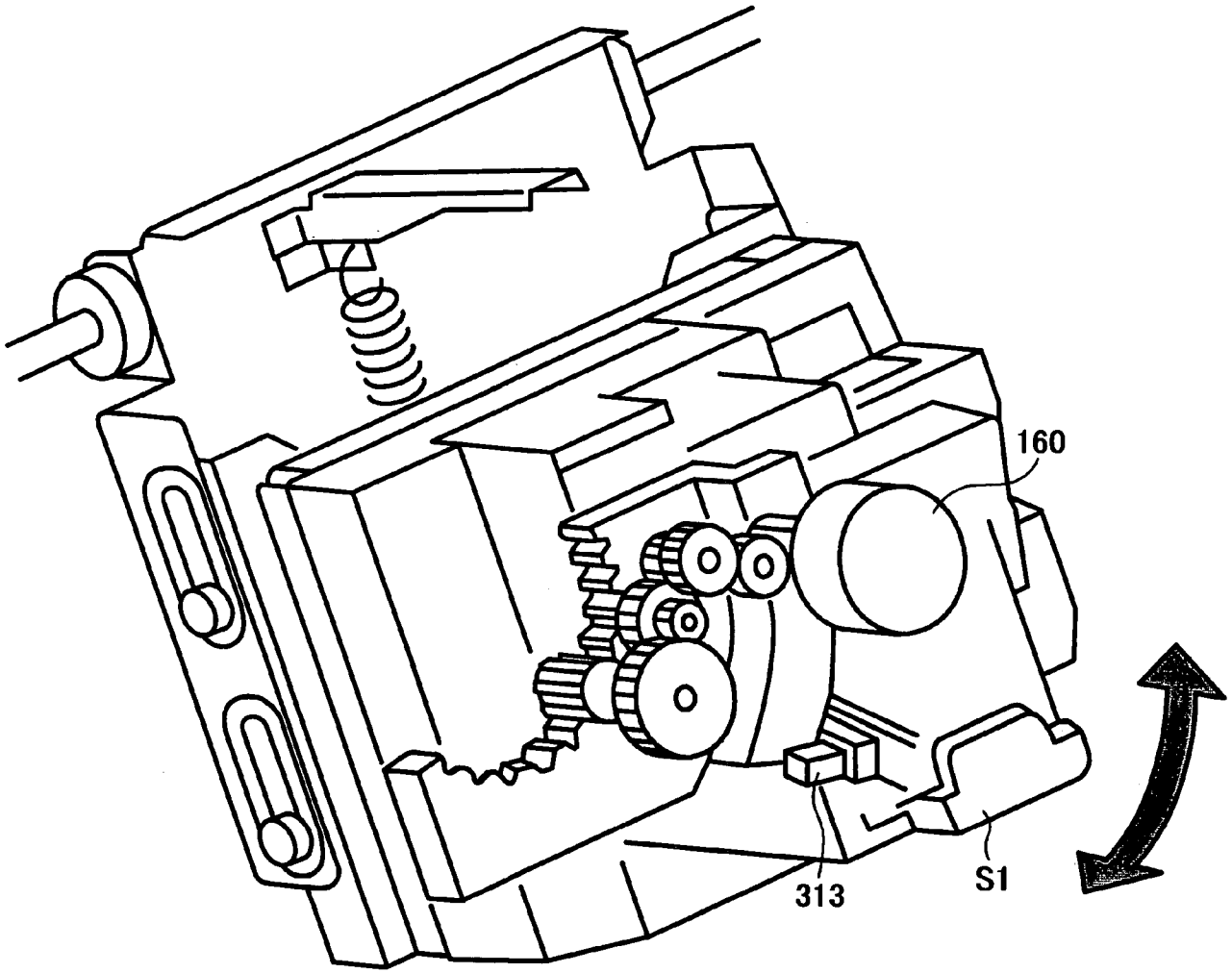
FIG. 9 is a perspective view of a rotating mechanism for rotating the end-stapling stapler of FIG. 8.

FIG. 8 is a perspective view of the end-stapling stapler S1 and a stapler moving mechanism. The end-stapling stapler S1 is driven by a stapler moving motor 159 via a timing belt. The stapler moving motor 159 can rotate in forward and reverse directions. The end-stapling stapler S1 moves in a sheet width direction to staple at one portion near a corner portion of a sheet bundle. A stapler home position sensor 312 is disposed at one side end of a moving range of the end-stapling stapler S1 to detect a home position of the end-stapling stapler S1. A stapling position in the sheet width direction is controlled based on a moving amount of the end-stapling stapler S1 from the home position. FIG. 9 is a perspective view of a rotating mechanism for rotating the end-stapling stapler S1 of FIG. 8. As seen from FIG. 9, the end-stapling stapler S1 is configured to change its stapling position such that a staple pin stapled on a sheet bundle is in parallel or slantwise relative to a side edge of the sheet bundle. The end-stapling stapler S1 is driven to rotate obliquely by a motor 160. When a staple oblique position sensor 313 detects that the end-stapling stapler S1 is rotated by a predetermined oblique angle, the motor 160 stops. Then, the end-stapling stapler S1 rotates to its original position after an oblique stapling operation is completed, and prepares for a next stapling operation.

As illustrated in FIGS. 1 and 5, the center-stapling stapler S2 is disposed such that a distance between the end fence 51 and a stapling position of the center-stapling stapler S2 is greater than a distance corresponding to a half of a length of a sheet of a maximum size in a sheet conveying direction which can be center-stapled. The two center-stapling staplers S2 are fixed onto a stay 63 and disposed in a symmetric state relative to the center of a span between the jogger fences 53. Because the center-stapling stapler S2 has a known configuration, a detail description is omitted here. Briefly, when performing center-staple processing, a sheet bundle is aligned in a direction perpendicular to a sheet conveying direction by the jogger fences 53, and the sheet bundle is aligned in the sheet conveying direction by the end fence 51 and the hitting roller 12. Subsequently, the trailing edge portion of the sheet bundle is lifted with the release claws 52*a* and 52*b* by driving the release belt 52 such that the central portion of the sheet bundle in the sheet conveying direction moves to the stapling position of the center-stapling staplers S2. The sheet bundle is center-stapled at this stapling position of the center-stapling staplers S2. The stapled sheet bundle is conveyed toward the sheet folding device G, and is subjected to center-folding processing. The operation of the sheet folding device G is described below. In FIG. 5, a reference character 64*a* indicates a front side plate, a reference character 64*b* indicates a rear side plate, and a reference character 310 indicates a sheet sensor that detects a sheet on the staple processing tray 500.

The sheet bundle subjected to the center-staple processing on the staple processing tray 500 is center-folded at the central portion of the sheet bundle. The center-folding processing is performed in the sheet folding device G. To convey a stapled sheet bundle from the sheet stapling device F to the sheet folding device G, a sheet bundle shifting mechanism is provided at the most downstream side of the staple processing tray 500 in the sheet conveying direction.

<Sheet Bundle Shifting Mechanism>

Figure 10:
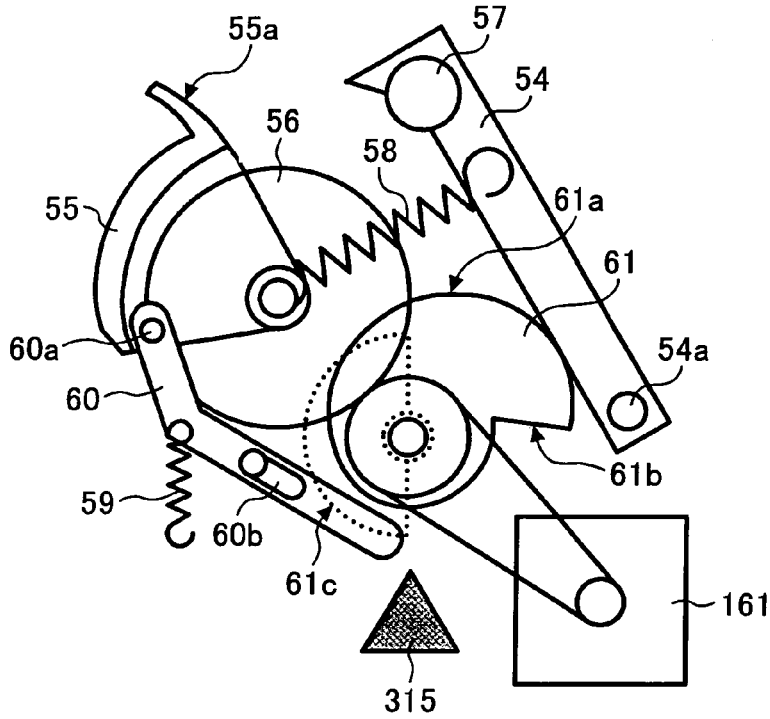
FIG. 10 is a diagram illustrating a state where a cam of a sheet shifting mechanism is located at its home position.
Figure 12:
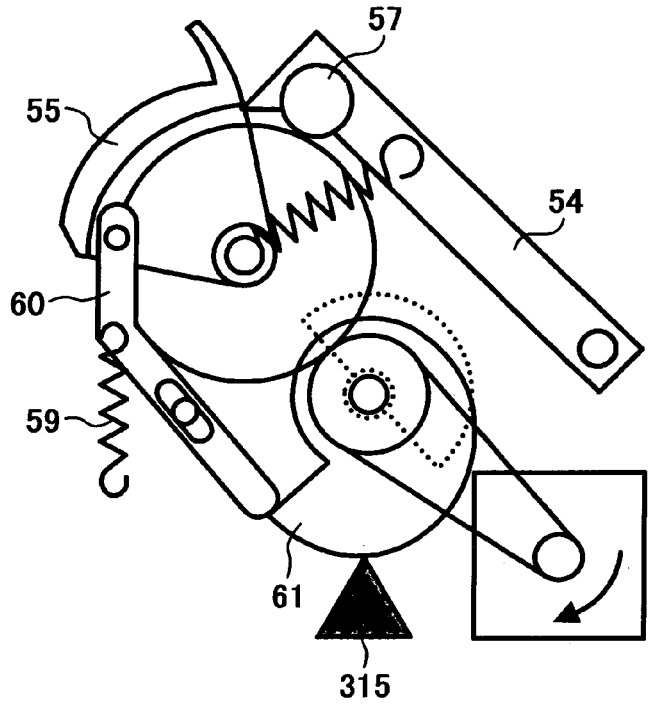
FIG. 12 is a diagram illustrating a state where a movable guide is rotated toward the branching guide plate to form a path for guiding a sheet bundle from the sheet stapling device to a sheet folding device.
Figure 15:
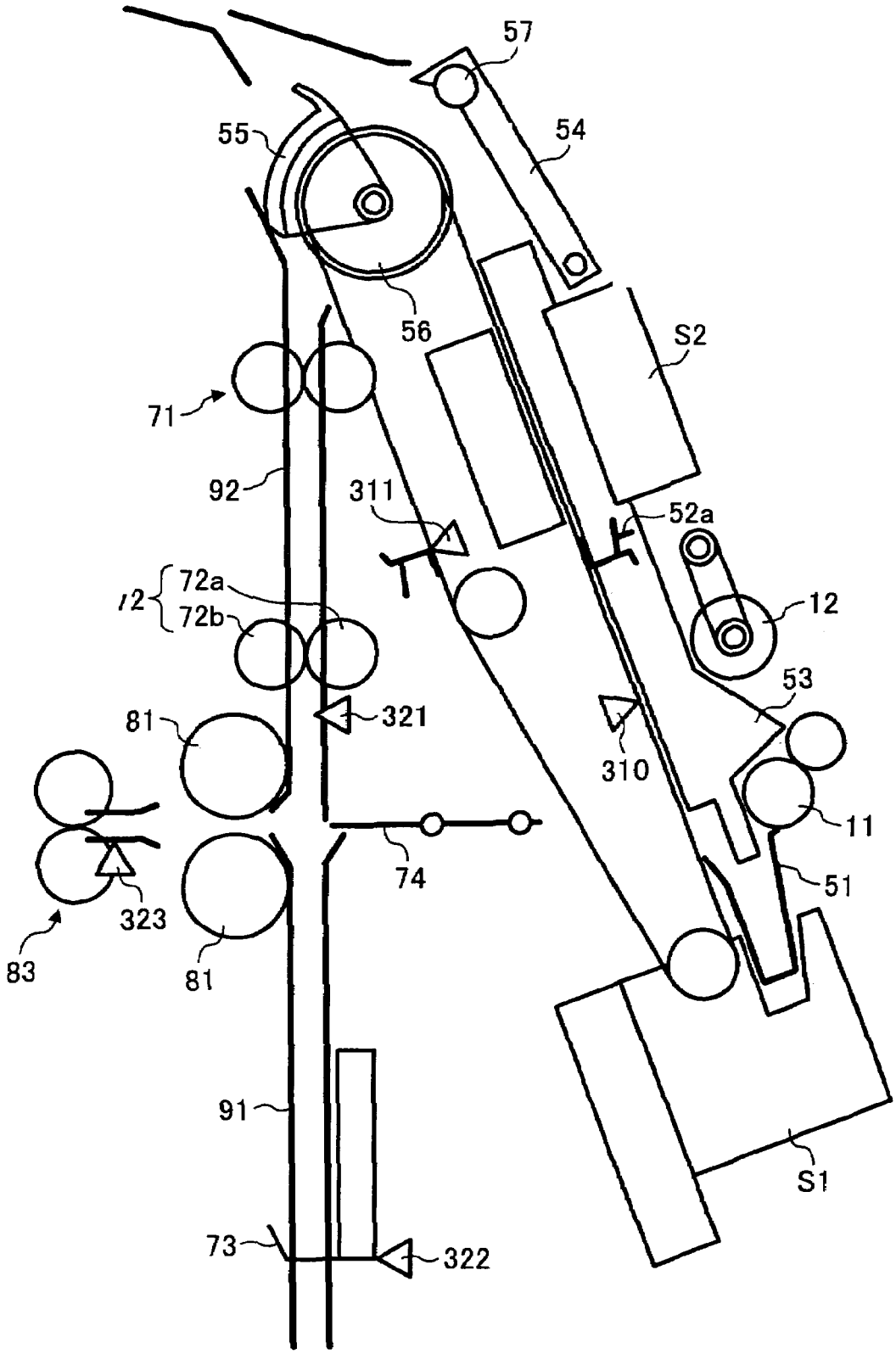
FIG. 15 is a diagram of the sheet stapling device and the sheet folding device.

As illustrated in FIGS. 1 and 15, the sheet bundle shifting mechanism includes a branching guide plate 54 and a movable guide 55. As illustrated in FIGS. 10 and 12, the branching guide plate 54 swings up and down about a supporting point 54*a*. Further, a rotatable pressing roller 57 is provided downstream of the branching guide plate 54 in the sheet conveying direction. The pressing roller 57 is pressed against the release roller 56 with a spring 58. The position of the branching guide plate 54 is regulated according to a contact position of the branching guide plate 54 with a cam surface 61*a* of a cam 61 driven to rotate by a drive motor 161.

The movable guide 55 is swingably supported by a rotation shaft of the release roller 56. A link arm 60 is rotatably provided at one end of the movable guide 55 (i.e., an end portion on the side opposite from the branching guide plate 54). The link arm 60 is connected to the movable guide 55 via a connection part 60*a*. A shaft fixed onto the front side plate 64*a* (shown in FIG. 5) fits loosely into an oblong portion 60*b* in the link arm 60. By this fit, the swing range of the movable guide 55 is regulated. The link arm 60 is held at a position in FIG. 10 by being biased downward by a spring 59. When the link arm 60 is pressed by the cam surface 61*b* of the cam 61 rotated by the drive motor 161, the movable guide 55 rotates upward.

A branching guide home position sensor 315 detects an interrupting portion 61 c of the cam 61, thereby detecting a home position of the cam 61. The stop position of the cam 61 is controlled with reference to the home position of the cam 61 by counting a number of drive pulses of the drive motor 161.

FIG. 10 illustrates a state where the cam 61 is located at its home position. A guide surface 55*a* of the movable guide 55 has a function of guiding a sheet bundle in a path toward the shift sheet discharging rollers 6.

Figure 11:
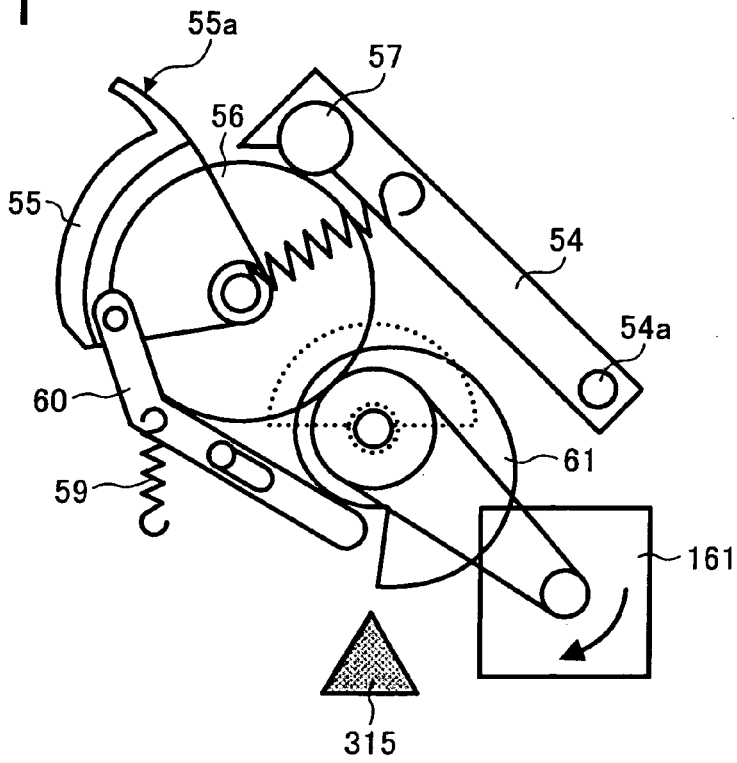
FIG. 11 is a diagram illustrating a state where a branching guide plate is rotated toward a release roller in the sheet shifting mechanism.

FIG. 11 illustrates a state where the branching guide plate 54 is rotated about the supporting point 54*a* in a counter-clockwise direction (downward) by rotating the cam 61 and the pressing roller 57 press-contacts the release roller 56.

FIG. 12 illustrates a state where the movable guide 55 is rotated in a clockwise direction (upward) by further rotating the cam 61 and a path for guiding a sheet or a sheet bundle from the sheet stapling device F to the sheet folding device G is formed by the branching guide plate 54 and the movable guide 55.

In this embodiment, the branching guide plate 54 and the movable guide 55 are operated by one drive motor. However, the movement timing and stop position of each of the branching guide plate 54 and the movable guide 55 may be controlled according to a sheet size and a number of stapled sheets by providing respective drive motors for the branching guide plate 54 and the movable guide 55.

<Sheet Folding Device>

Figure 13:
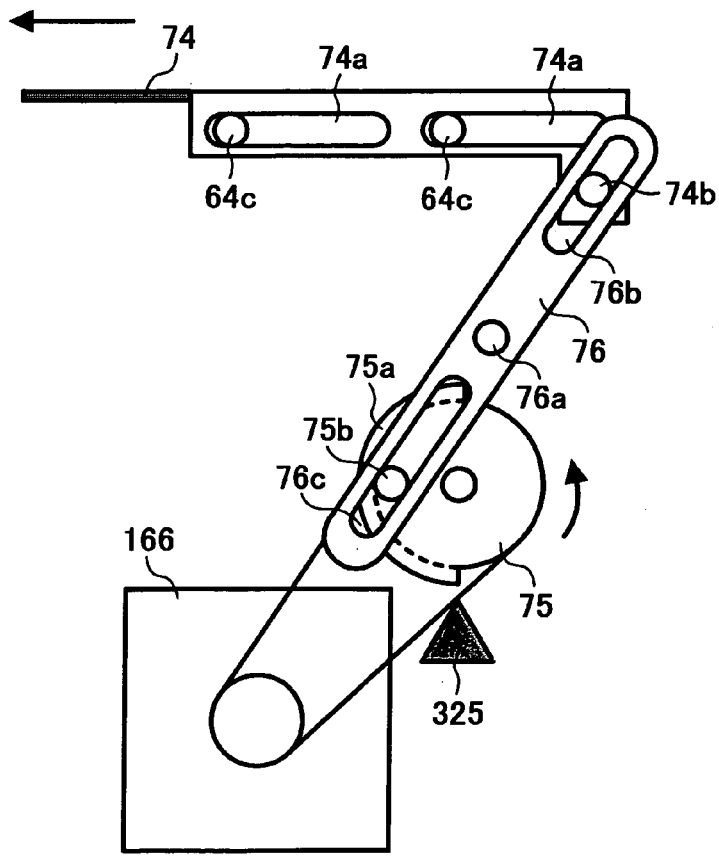
FIG. 13 is a diagram illustrating an operation of a moving mechanism of a folding plate when the folding plate is located at a home position before performing center-folding processing.
Figure 14:
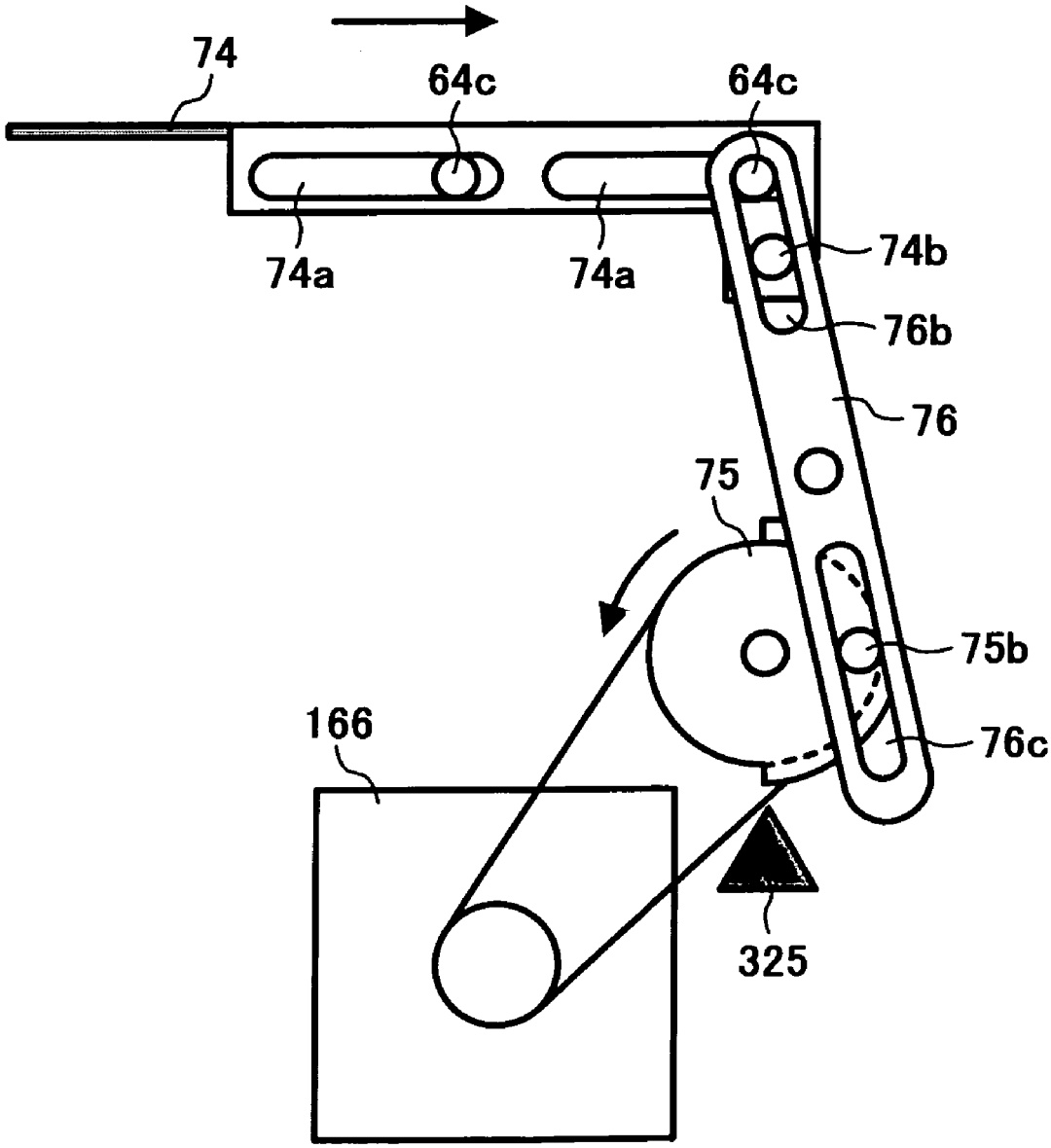
FIG. 14 is a diagram illustrating an operation of the moving mechanism of the folding plate when the folding plate retracts toward the home position after performing center-folding processing.

FIGS. 13 and 14 are diagrams illustrating an operation of a moving mechanism of the folding plate 74 used in center-folding processing.

The folding plate 74 is supported by fitting loosely two shafts 64*c* standing on the front and rear side plates 64*a* and 64*b* in oblong hole portions 74*a*. Further, a shaft portion 74*b* provided on the folding plate 74 fits loosely in an oblong hole portion 76*b* of a link arm 76. By swinging the link arm 76 about a supporting point 76*a*, the folding plate 74 reciprocates in the right and left directions in FIGS. 13 and 14.

Specifically, a shaft portion 75*b* of a folding plate drive cam 75 fits loosely in an oblong hole portion 76*c* of the link arm 76. The link arm 76 swings by rotating the folding plate drive cam 75. By the swing motions of the link arm 76, the folding plate 74 reciprocates in a direction perpendicular to sheet conveying guide upper and lower plates 92 and 91 in FIG. 15.

A folding plate motor 166 drives the folding plate drive cam 75 to rotate in an arrow direction in FIG. 13. The stop position of the folding plate drive cam 75 is determined by detecting both end portions of a semilunar interrupting portion 75*a* with a folding plate home position sensor 325.

FIG. 13 illustrates a state where the folding plate 74 is located at a home position where the folding plate 74 is retracted from a sheet accommodating area in the sheet folding device G. The folding plate 74 moves in an arrow direction by rotating the folding plate drive cam 75 in the arrow direction, and advances toward the sheet accommodating area in the sheet folding device G. FIG. 14 illustrates a state where the folding plate 74 is located at a position where the folding plate 74 pushes a central portion of a sheet bundle in the sheet folding device G into a nip part between a pair of folding rollers 81. The folding plate 74 moves in an arrow direction by rotating the folding plate drive cam 75 in an arrow direction in FIG. 14, and retracts from the sheet accommodating area in the sheet folding device G.

In this embodiment, it is assumed that center-folding processing is performed on a stapled sheet bundle. However, the center-folding processing may also be performed on a single sheet. In this case, a single sheet is conveyed toward the sheet folding device G without being subjected to staple processing in the sheet stapling device F. After center-folding processing is performed on the single sheet by using the folding plate 74 and the folding rollers 81, the center-folded single sheet is discharged to the lower tray 203.

<Control Device>

Figures 16, 16A:
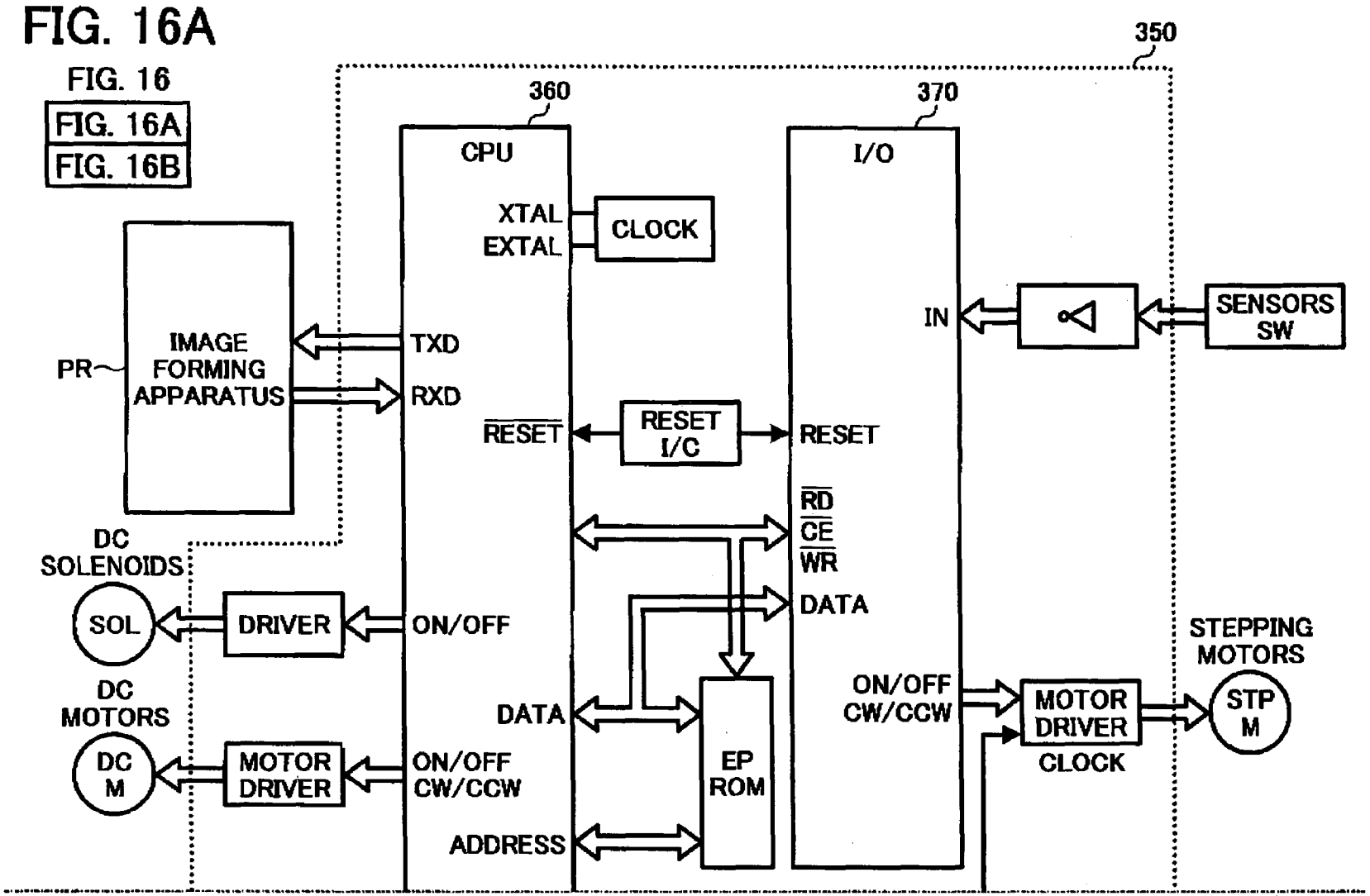
FIG. 16 is a block diagram of a control device of the sheet post-processing apparatus of FIG. 1.
Figure 16B:
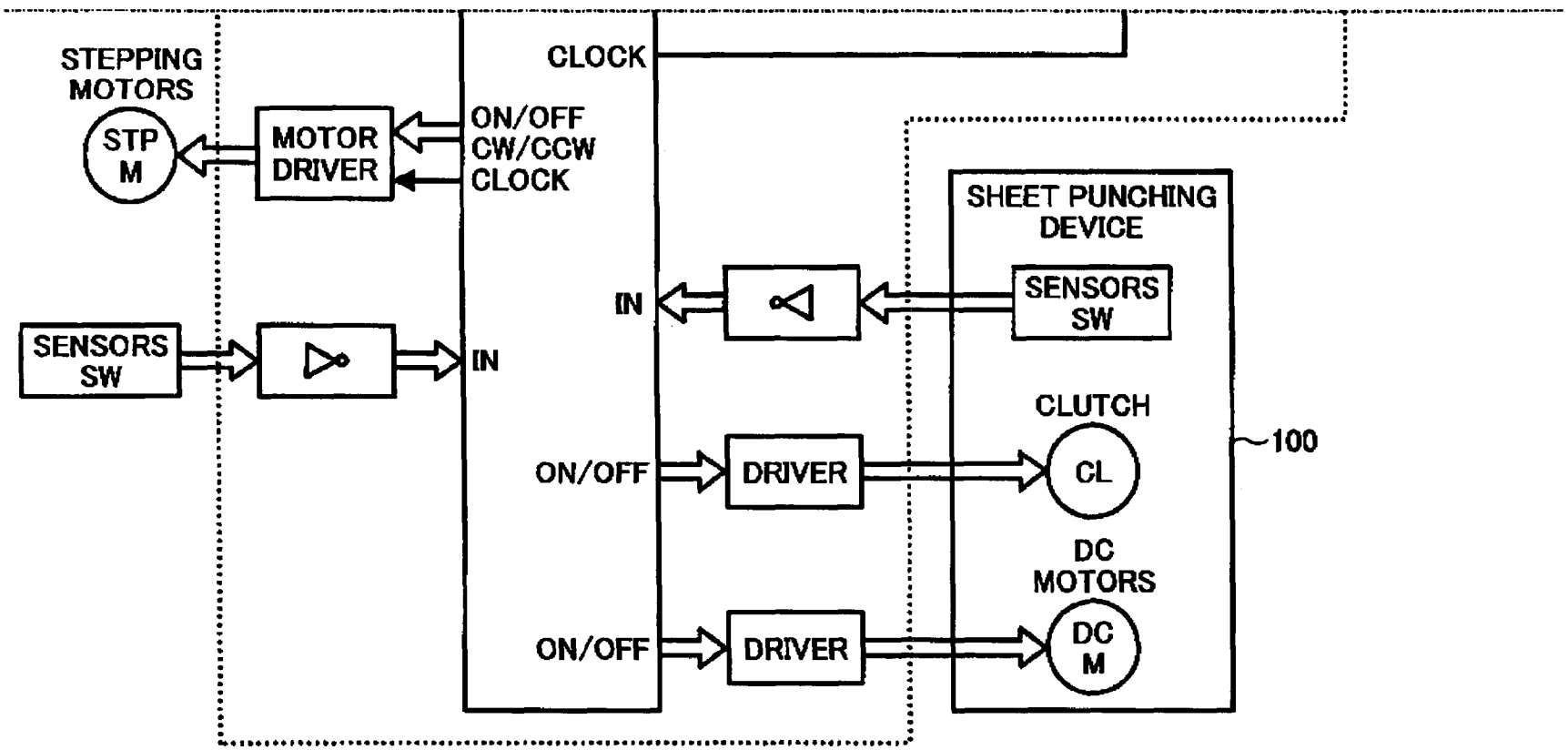
Figure 17:
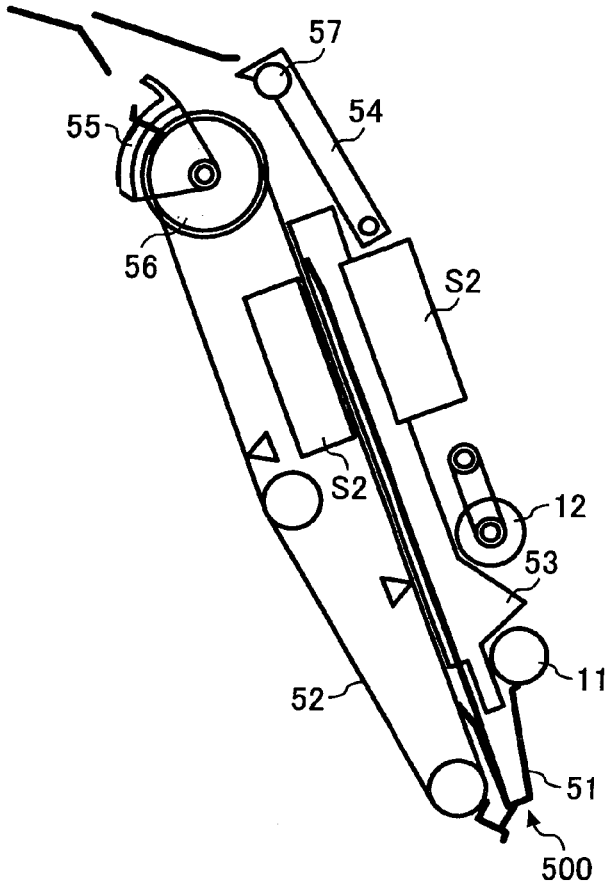
FIG. 17 is a diagram illustrating a state where sheets are aligned in the sheet stapling device.

With reference to FIG. 16, a control device 350 is formed from a microcomputer including a central processing unit (CPU) 360 and an input/output (I/O) interface 370 in the sheet post-processing apparatus PD. Signals output from each of switches of a control panel (not shown) of a main body of the image forming apparatus PR and signals output from each of sensors of the sheet post-processing apparatus PD are input to the CPU 360 via the I/O interface 370. The sensors of the sheet post-processing apparatus PD of the present example embodiment include the entrance sensor 301 (shown in FIG. 1), an upper sheet discharging sensor 302 (shown in FIG. 1), the shift discharging sensor 303 (shown in FIG. 1), a pre-stack sensor 304 (shown in FIG. 1), a staple sheet discharging sensor 305 (shown in FIG. 1), the sheet sensor 310 (shown in FIGS. 1 and 5), the release belt home position sensor 311 (shown in FIGS. 1 and 7), the stapler home position sensor 312 (shown in FIG. 8), a staple oblique position sensor 313 (shown in FIG. 9), a jogger fence home position sensor (not shown), the branching guide home position sensor 315 (shown in FIGS. 10 through 12), a sheet sensor 321, a movable rear end fence home position sensor 322, a folded sheet passage sensor 323, the folding plate home position sensor 325 (shown in FIGS. 13 and 14), the sheet surface detecting sensor 330 (shown in FIGS. 1 and 3), a guide plate open/close sensor 331 (shown in FIG. 4), and the folding detecting sensor 601 (described below).

The CPU 360 controls the drive of solenoids such as the solenoid 170 (shown in FIG. 6), and the motors of the sheet post-processing apparatus PD based on input signals. The motors of the sheet post-processing apparatus PD of the present example embodiment include the tray raising and lowering motor 168 (shown in FIG. 3) for raising and lowering the shift tray 202, the guide plate open/close motor 167 (shown in FIG. 4) for opening and closing open/close guide plate 33, the shift motor 169 (shown in FIG. 2) for moving the shift tray 202, a hitting roller motor (not shown) for driving the hitting roller 12, conveyor motors for driving the conveyor rollers, discharging motors for driving the sheet discharging rollers, the release motor 157 (shown in FIG. 5) for driving the release belt 52, the stapler moving motor 159 (shown in FIG. 8) for moving the end-stapling stapler S1, the motor 160 (shown in FIG. 9) for obliquely rotating the end-stapling stapler S1, the jogger motor 158 (shown in FIG. 6) for moving the jogger fences 53, the drive motor 161 (shown in FIG. 10) for rotating the branching guide plate 54 and the movable guide 55, a sheet bundle conveyor motor (not shown) for driving sheet bundle conveyor rollers, a rear end fence motor 163 (shown in FIG. 26; e.g., a drive device configured to move a sheet position adjusting unit) for moving a movable rear end fence 73 (e.g., a sheet position adjusting unit), the folding plate motor 166 (shown in FIGS. 13 and 14) for moving the folding plate 74, a folding motor M (not shown) for driving sheet conveying upper and lower rollers 71 and 72 (e.g., a sheet conveying unit), the folding rollers 81, and sheet discharging rollers 83 (described below). Pulse signals of a staple conveyor motor (not shown) for driving the staple sheet discharging rollers 11 are input to the CPU 360 and counted. The solenoid 170 and the jogger motor 158 are controlled according to the counted pulse signals.

Each of the rear end fence motor 163 and the folding motor M is formed from a stepping motor (pulse motor), and the CPU 360 directly controls the rear end fence motor 163 and the folding motor M via a motor driver or indirectly controls the folding roller drive motor via the I/O 370 and the motor driver. Further, the sheet punching device 100 performs a punching operation based on the instruction of the CPU 360 which controls the clutch and motor for the sheet punching device 100. The control of the sheet post-processing apparatus PD is executed by running a program recorded in a ROM (not shown) by the CPU 360 while using a RAM (not shown) as a work area.

Hereafter, the operation of the sheet post-processing apparatus PD executed by the CPU 360 according to the example embodiment is described. In this embodiment, the sheet post-processing apparatus PD performs the following sheet post-processing modes.

(1) Non-staple mode A
(2) Non-staple mode B
(3) Sort/stack mode
(4) Staple mode
(5) Center-stapling bookbinding mode
(6) Simple bookbinding mode (1) Non-staple Mode A In the non-staple mode A, a sheet is conveyed in the sheet conveying paths A and B to the upper tray 201 without being subjected to staple processing. In this mode, the branching pawl 15 is rotated in a clockwise direction in FIG. 1 so that the sheet conveying path B is opened. When the non-staple mode A is selected on an operation panel of the image forming apparatus PR and when a sheet is conveyed from the image forming apparatus PR to the sheet post-processing apparatus PD, the entrance rollers 1 and the conveyor rollers 2 in the sheet conveying path A and conveyor rollers 3 and upper sheet discharging rollers 4 in the sheet conveying path B start rotating in the sheet post-processing apparatus PD. Then, the CPU 360 checks about a conveyance of a sheet by checking if the entrance sensor 301 and the upper sheet discharging sensor 302 are turned on or off. After a last sheet has been conveyed and predetermined time has elapsed, the entrance rollers 1, the conveyor rollers 2, the conveyor rollers 3, and the upper sheet discharging rollers 4 stop rotating. By these operations, all the sheets conveyed from the image forming apparatus PR to the sheet post-processing apparatus PD are discharged and stacked onto the upper tray 201 without being subjected to staple processing. In this embodiment, the sheet punching device 100 is provided between the entrance rollers 1 and the conveyor rollers 2 to punch at predetermined positions of a sheet conveyed in the sheet conveying path A.

(2) Non-staple Mode B

In the non-staple mode B, a sheet is conveyed in the sheet conveying paths A and C to the shift tray 202 without being subjected to staple processing. In this mode, the branching pawl 15 is rotated in a counter-clockwise direction and the branching pawl 16 is rotated in a clockwise direction in FIG. 1 so that the sheet conveying path C is opened. When the non-staple mode B is selected on the operation panel of the image forming apparatus PR and when a sheet is conveyed from the image forming apparatus PR to the sheet post-processing apparatus PD, the entrance rollers 1 and the conveyor rollers 2 in the sheet conveying path A and conveyor rollers 5 and the shift sheet discharging rollers 6 in the sheet conveying path C start rotating in the sheet post-processing apparatus PD. By turning on the solenoids for driving the branching pawls 15 and 16, the branching pawl 15 is rotated in a counter-clockwise direction and the branching pawl 16 is rotated in a clockwise direction. Subsequently, the CPU 360 checks about a conveyance of a sheet by checking if the entrance sensor 301 and the shift sheet discharging sensor 303 are turned on or off. After a last sheet has been conveyed and predetermined time has elapsed, the entrance rollers 1, the conveyor rollers 2, the conveyor rollers 5, and the shift sheet discharging rollers 6 stop rotating, and the solenoids for driving the branching pawls 15 and 16 are turned off. By these operations, all the sheets conveyed from the image forming apparatus PR to the sheet post-processing apparatus PD are discharged and stacked onto the shift tray 202 without being subjected to staple processing. The sheet punching device 100 may punch at predetermined positions of a sheet conveyed in the sheet conveying path A.

(3) Sort/stack Mode

In the sort/stack mode, a sheet is conveyed in the sheet conveying paths A and C to the shift tray 202, and sheets discharged to the shift tray 202 are sorted for each predetermined number of sheets by shifting the shift tray 202 in a direction perpendicular to a sheet discharging direction. Similarly to the non-staple mode B, the branching pawl 15 is rotated in a counter-clockwise direction and the branching pawl 16 is rotated in a clockwise direction in FIG. 1 so that the sheet conveying path C is opened. When the sort/stack mode is selected on the operation panel of the image forming apparatus PR and when a sheet is conveyed from the image forming apparatus PR to the sheet post-processing apparatus PD, the entrance rollers 1 and the conveyor rollers 2 in the sheet conveying path A and conveyor rollers 5 and the shift sheet discharging rollers 6 in the sheet conveying path C start rotating in the sheet post-processing apparatus PD. By turning on the solenoids for driving the branching pawls 15 and 16, the branching pawl 15 is rotated in a counter-clockwise direction and the branching pawl 16 is rotated in a clockwise direction. Subsequently, the CPU 360 checks about a conveyance of a sheet by checking if the entrance sensor 301 and the shift sheet discharging sensor 303 are turned on or off.

If a first sheet of a set of sheets passes the shift sheet discharging sensor 303, the shift motor 169 is turned on and the shift tray 202 is shifted in the direction perpendicular to the sheet discharging direction until the shift sensor 336 detects the shift tray 202. Then, the first sheet is discharged to the shift tray 202, and the shift sheet discharging sensor 303 becomes off. If a set designated by an operator includes only one sheet, the conveyor rollers 2, the conveyor rollers 5, and the shift sheet discharging rollers 6 stop rotating, and the solenoids for driving the branching pawls 15 and 16 are turned off. If a set designated by the operator includes a plurality of sheets, a subsequent sheet is discharged to the shifted shift tray 202. After a last sheet of a set of sheets has passed the shift sheet discharging sensor 303 and predetermined time has elapsed, the entrance rollers 1, the conveyor rollers 2, the conveyor rollers 5, and the shift sheet discharging rollers 6 stop rotating, and the solenoids for driving the branching pawls 15 and 16 are turned off. By these operations, all the sheets conveyed from the image forming apparatus PR to the sheet post-processing apparatus PD are discharged, sorted, and stacked onto the shift tray 202 without being subjected to staple processing. The sheet punching device 100 may punch at predetermined positions of a sheet conveyed in the sheet conveying path A.

(4) Staple Mode

In the staple mode, a sheet is conveyed in the sheet conveying paths A and D to the sheet stapling device F. Sheets are aligned and stapled in the sheet stapling device F, and a stapled sheet bundle is discharged to the shift tray 202 through the sheet conveying path C. In this mode, the branching pawls 15 and 16 are rotated in the counter-clockwise directions, respectively, and a sheet conveying path from the sheet conveying path A to the sheet conveying path D is opened. When the staple mode is selected on the operation panel of the image forming apparatus PR and when a sheet is conveyed from the image forming apparatus PR to the sheet post-processing apparatus PD, the entrance rollers 1 and the conveyor rollers 2 in the sheet conveying path A, and the conveyor rollers 7, 9, 10 and the staple sheet discharging rollers 11 in the sheet conveying path D, and the hitting roller 12 in the sheet stapling device F start rotating in the sheet post-processing apparatus PD. By turning on the solenoid for driving the branching pawl 15, the branching pawl 15 is rotated in a counter-clockwise direction.

After the home position of the end-stapling stapler S1 is checked by detecting the end-stapling stapler S1 with the stapler home position sensor 312, the end-stapling stapler S1 is moved to a stapling position by driving the stapler moving motor 159. Further, after the home position of the release belt 52 is checked by detecting the release belt 52 with the release belt home position sensor 311, the release belt 52 is moved to its standby position by driving the release motor 157. Moreover, after the home position of the jogger fences 53 is detected with the jogger fence home position sensor (not shown), the jogger fences 53 are moved to their standby position. Further, the branching guide plate 54 and the movable guide 55 are moved to their home positions.

If the entrance sensor 301 is turned on and off, the staple sheet discharging sensor 305 is turned on, and the shift discharging sensor 303 is turned off, it is assumed that a sheet is conveyed to the sheet stapling device F. In this case, the solenoid 170 is turned on for a predetermined time, and the hitting roller 12 swings to contact a surface of a sheet conveyed to the staple processing tray 500. After contacting, the hitting roller 12 rotates to move the sheet toward the end fence 51, so that the trailing edge of the sheet in the sheet conveying direction is made to abut against the end fence 51 to be aligned with other sheets in the sheet conveying direction. Subsequently, the jogger fences 53 are moved inward by a predetermined distance by driving the jogger motor 158, and thereby a sheet is aligned in a sheet width direction, that is, a direction perpendicular to a sheet conveying direction. After the alignment operation, the jogger fences 53 are returned to their standby position. By these alignment operations, the sheet conveyed onto the staple processing tray 500 is aligned in a lengthwise direction (i.e., a sheet conveying direction) and in a widthwise direction (i.e., a direction perpendicular to a sheet conveying direction). These alignment operations are performed every time a sheet is conveyed onto the staple processing tray 500. After a last sheet of a sheet bundle is aligned, the jogger fences 53 move inward by a predetermined distance so as not to shift the edge surfaces of the sheet bundle. In this condition, the end-stapling stapler S1 is turned on to perform end-staple processing on the sheet bundle.

At this time, the shift tray 202 is lowered by a predetermined distance to prepare for receiving the stapled sheet bundle. Further, the shift sheet discharging rollers 6 start rotating by driving a motor (not shown), and the release belt 52 is rotated by a predetermined distance by turning on the release motor 157, thereby pushing up the stapled sheet bundle toward the sheet conveying path C. Subsequently, the shift sheet discharging rollers 6 pinch the stapled sheet bundle at a nip part between the shift sheet discharging rollers 6 and discharge it to the shift tray 202. After the shift discharging sensor 303 is turned on and off by the passage of the stapled sheet bundle, the release belt 52 and the jogger fences 53 are moved to their standby positions. Further, the shift sheet discharging rollers 6 stop rotating after a predetermined time has elapsed, and the shift tray 202 is raised to a predetermined position. This position is controlled by detecting an upper surface of an uppermost sheet of the sheet bundle stacked on the shift tray 202 with the sheet surface detecting sensor 330. These sequential operations are repeated until a job is completed.

After the job is completed, the end-stapling stapler S1, the release belt 52, the jogger fences 53 are moved to their home positions, and the entrance rollers 1, the conveyor rollers 2, 7, 9, 10, 11, and the hitting roller 12 stop rotating. Further, the branching pawl 15 is returned to its original position by turning off the solenoid (not shown). By these operations, the sheets conveyed from the image forming apparatus PR to the sheet post-processing apparatus PD are subjected to staple processing in the sheet stapling device F, and a stapled sheet bundle is discharged and stacked onto the shift tray 202. The sheet punching device 100 may punch at predetermined positions of a sheet conveyed in the sheet conveying path A.

The operation of the sheet stapling device F in the staple mode is described in detail. When the staple mode is selected by an operator, as illustrated in FIG. 6, the jogger fences 53 move from the home positions to the standby positions. The standby positions are located at positions away from side edges of a sheet in a sheet width direction conveyed to the staple processing tray 500 by about 7 mm, respectively. When a sheet is conveyed by the conveyor rollers 11 and a trailing edge of the sheet passes the staple sheet discharging sensor 305, each of the jogger fences 53 moves inward from the standby position by about 5 mm, and stops.

The staple sheet discharging sensor 305 detects the passage of the trailing edge of the sheet and outputs a detection signal to the CPU 360. Then, the CPU 360 starts counting a number of pulses of a motor (not shown) for driving the conveyor rollers 11 upon receiving the detection signal from the staple sheet discharging sensor 305. After the CPU 360 counts a predetermined pulse number, the CPU 360 turns the solenoid 170 on. The hitting roller 12 swings by on/off operations of the solenoid 170. By the on operation of the solenoid 170, the hitting roller 12 rotates to move the sheet toward the end fence 51, so that the trailing edge of the sheet in the sheet conveying direction is made to abut against the end fence 51 to be aligned. Every time a sheet to be conveyed to the staple processing tray 500 passes the entrance sensor 301 or the staple sheet discharging sensor 305, a detection signal is input to the CPU 360, and thereby the CPU 360 counts a number of sheets.

After a predetermined time has elapsed since the solenoid 170 is turned off, each of the jogger fences 53 is driven to move inward by about 2.6 mm by the jogger motor 158, and halts. By this operation, the side edges of the sheet in a sheet width direction are aligned. Subsequently, each of the jogger fences 53 moves outward by about 7.6 mm to the standby position, and waits for a subsequent sheet. These operations are repeated until alignment for a last sheet of a sheet bundle is completed. After a sheet bundle is stacked on the staple processing tray 500, each of the jogger fences 53 moves inward by about 7 mm again and halts, and securely aligns both side edges of the sheet bundle to be subjected to staple processing. After a predetermined time has elapsed, the end-stapling stapler S1 is driven to operate by a staple motor (not shown), and performs end-staple processing on the sheet bundle. If an operator designated two or more stapling positions, the stapler moving motor 159 is driven after staple processing at the first stapling position is completed. Then, the end-stapling stapler S1 moves along the trailing edge of the sheet bundle, and performs next staple processing at the second stapling position.

After the staple processing is completed, the release belt 52 is driven by the release motor 157. Further, the shift sheet discharging rollers 6 start rotating to receive the sheet bundle lifted by the release claw 52*a*. At this time, the operation of the jogger fences 53 is controlled according to a sheet size and a number of stapled sheets. If a number of stapled sheets is less than a preset number or a sheet size is smaller than a preset sheet size, a trailing edge of a sheet bundle is hooked and conveyed by the release claw 52*a* while pressing the sheet bundle by the jogger fences 53. After a predetermined pulses are counted based on a detection signal of the sheet sensor 310 or the release belt home position sensor 311, the pressing of the jogger fences 53 against the sheet bundle is released by retracting each of the jogger fences 53 by about 2 mm. If a number of stapled sheets is greater than a preset number or a sheet size is larger than a preset sheet size, each of the jogger fences 53 is retracted by about 2 mm in advance, and a sheet bundle is released. In both cases, after the sheet bundle passes through the jogger fences 53, each of the jogger fences 53 further moves outward by about 5 mm to the standby position to prepare for a subsequent sheet.

(5) Center-stapling Bookbinding Mode

Figure 19:
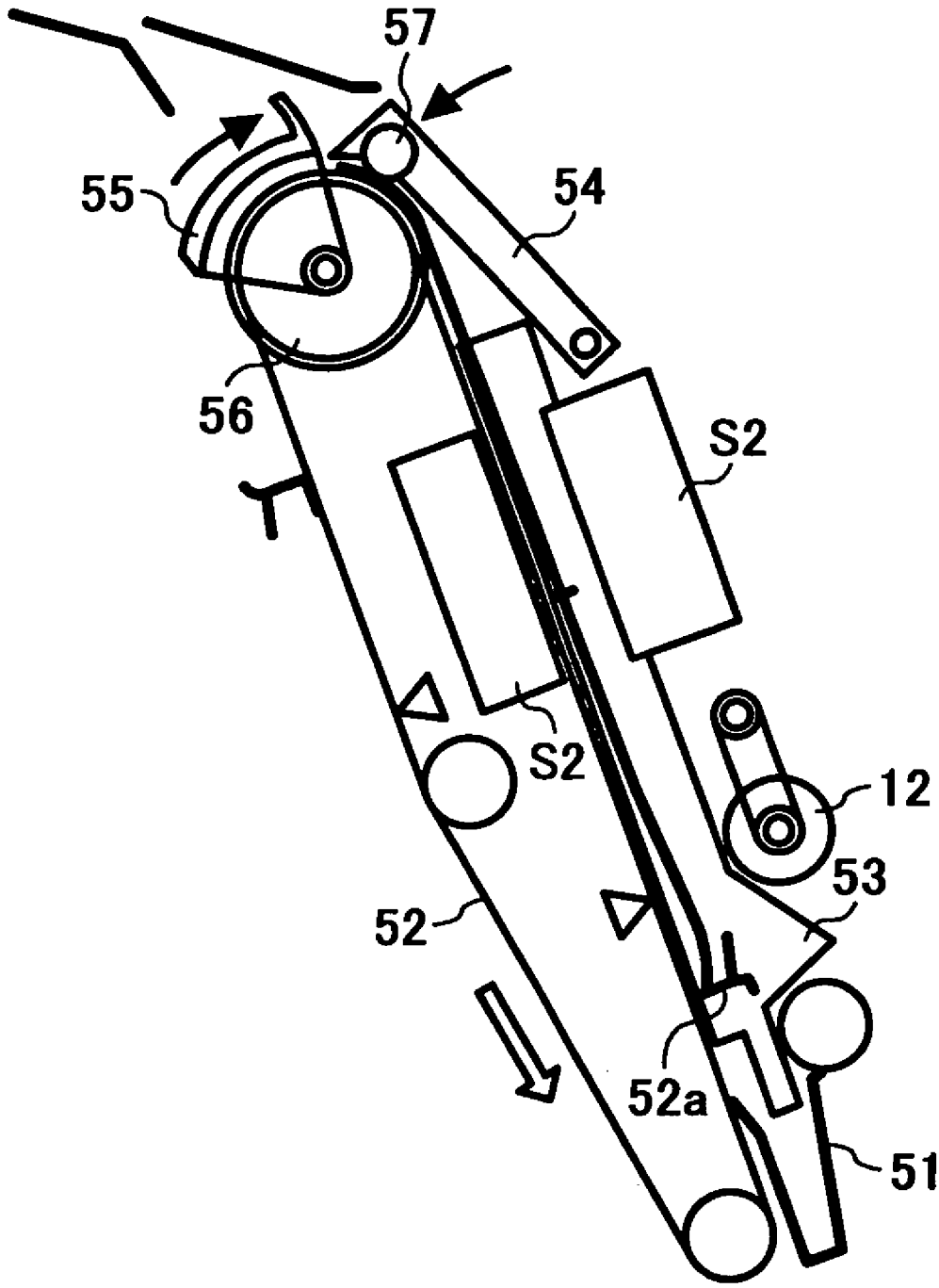
FIG. 19 is a diagram illustrating a state where the sheet bundle is conveyed from the sheet stapling device toward the sheet folding device.

In the center-stapling bookbinding mode, a sheet is conveyed in the sheet conveying paths A and D to the sheet stapling device F. After sheets are aligned and stapled in the sheet stapling device F, a stapled sheet bundle is subjected to center-folding processing in the sheet folding device G, and a center-folded sheet bundle is discharged to the lower tray 203 via the sheet conveying path H. In this mode, the branching pawls 15 and 16 are rotated in the counter-clockwise directions, respectively, and a sheet conveying path from the sheet conveying path A to the sheet conveying path D is opened. Further, the branching guide plate 54 and the movable guide plate 55 go in a closed state as illustrated in FIG. 19, thereby guiding the stapled sheet bundle to the sheet folding device G.

5-1) Processing Procedures

When the center-stapling bookbinding mode is selected on the operation panel of the image forming apparatus PR and when a sheet is conveyed from the image forming apparatus PR to the sheet post-processing apparatus PD, the entrance rollers 1 and the conveyor rollers 2 in the sheet conveying path A, the conveyor rollers 7, 9, 10, 11 in the sheet conveying path D, and the hitting roller 12 in the sheet stapling device F start rotating in the sheet post-processing apparatus PD. By turning on the solenoid for driving the branching pawl 15, the branching pawl 15 is rotated in a counter-clockwise direction.

After detecting the home position of the release belt 52 with the release belt home position sensor 311, the release belt 52 is moved to its standby position by driving the release motor 157. Further, after detecting the home position of the jogger fences 53 with the jogger fence home position sensor, the jogger fences 53 are moved to their standby position. Moreover, the branching guide plate 54 and the movable guide 55 are moved to their home positions.

If the entrance sensor 301 is turned on and off, the staple sheet discharging sensor 305 is turned on, and the shift discharging sensor 303 is turned off, it is assumed that a sheet is conveyed to the sheet stapling device F. In this case, the solenoid 170 is turned on for a predetermined time, and the hitting roller 12 swings to contact a surface of a sheet conveyed to the staple processing tray 500. After contacting, the hitting roller 12 rotates to move the sheet toward the end fence 51, so that the trailing edge of the sheet in the sheet conveying direction is made to abut against the end fence 51 to be aligned with other sheets in the sheet conveying direction. Subsequently, the jogger fences 53 are moved inward by a predetermined distance by driving the jogger motor 158, and thereby a sheet is aligned in a sheet width direction, that is, a direction perpendicular to a sheet conveying direction. After the alignment operation, the jogger fences 53 are returned to their standby position. By these alignment operations, the sheet conveyed onto the staple processing tray 500 is aligned in a lengthwise direction (i.e., a sheet conveying direction) and in a widthwise direction (i.e., a direction perpendicular to a sheet conveying direction). These alignment operations are performed every time a sheet is conveyed onto the staple processing tray 500. After a last sheet of a sheet bundle is aligned, the jogger fences 53 move inward by a predetermined distance so as not to shift the edge surfaces of the sheet bundle. In this condition, the release belt 52 is rotated by a predetermined distance by driving the release motor 157 to raise the sheet bundle to a stapling position of the center-stapling staplers S2. Subsequently, center-stapling processing is performed at a central portion of the sheet bundle by turning on the center-stapling staplers S2. Next, a path for conveying the stapled sheet bundle to the sheet folding device G is formed by shifting the branching guide plate 54 and the movable guide 55 by a predetermined amount. Further, sheet conveying upper and lower rollers 71 and 72 in the sheet folding device G start rotating. After detecting the home position of the movable rear end fence 73 provided in the sheet folding device G, the rear end fence 73 is moved to its standby position.

When the sheet folding device G is ready for receiving a stapled sheet bundle, the release belt 52 is further rotated by a predetermined distance. After the leading edge of the stapled sheet bundle is pinched between the release roller 56 and the pressing roller 57, the sheet bundle is conveyed toward the sheet folding device G. When the leading edge of the sheet bundle reaches the sheet sensor 321, the folding rollers 81 are rotated in the reverse direction, thereby conveying the sheet bundle downward without deflecting in a portion indicated by a reference character "Q" (hereafter referred to as a "portion Q") in FIG. 20. Subsequently, after a predetermined time has elapsed in which the leading edge of the sheet bundle is assumed to have passed through the portion "Q", the folding rollers 81 stop rotating. After the sheet bundle is conveyed by a predetermined distance, the sheet conveying upper and lower rollers 71 and 72 stop rotating, and pressure between the sheet conveying lower rollers 72 is released. Subsequently, a folding operation of the folding plate 74 is started, and the folding rollers 81 and sheet discharging rollers 83 start rotating. When the leading edge of the center-folded sheet bundle passes the folded sheet passage sensor 323, the folding plate 74 is moved to its home position. When the sheet sensor 321 becomes off, the sheet conveying lower rollers 72 contact with each other with pressure, and the branching guide plate 54 and the movable guide plate 55 are moved to their home positions.

When the trailing edge of the center-folded sheet bundle passes the folded sheet passage sensor 323, the folding rollers 81 and the sheet discharging rollers 83 are further rotated for a predetermined time and stopped. Subsequently, the release belt 52 and the jogger fences 53 are moved to their standby positions. The CPU 360 checks if it is a last portion of a job. If it is not the last portion of the job, the above-described operations are similarly performed for subsequent sheets. If it is the last portion of the job, the release belt 52 and the jogger fences 53 are moved to their home positions, and the entrance rollers 1, the conveyor rollers 2, 7, 9, 10, 11, and the hitting roller 12 stop rotating. Further, the branching pawl 15 is returned to its original position by turning off the solenoid (not shown). By these operations, the sheets conveyed from the image forming apparatus PR to the sheet post-processing apparatus PD are subjected to center-staple processing in the sheet stapling device F, and a center-stapled sheet bundle is center-folded in the sheet folding device G, and a center-folded sheet bundle is discharged and stacked onto the lower tray 203.

5-2) Operation

FIGS. 17 through 24 are diagrams illustrating operations of the sheet folding device G in the center-stapling bookbinding mode. In FIGS. 17 through 24, illustrations and descriptions of a pressure-applying mechanism for contacting the pair of folding rollers 81 each other and a pressure-releasing mechanism for separating the folding rollers 81 from each other are omitted. In the center-stapling bookbinding mode, a sheet conveyed in the sheet conveying path A is directed by the branching pawls 15 and 16 and conveyed by the conveyor rollers 7, 9, and 10 to the sheet conveying path D. Subsequently, the sheet is conveyed to the staple processing tray 500 of the sheet stapling device F by the conveyor rollers 11. On the staple processing tray 500, the sheets sequentially conveyed by the conveyor rollers 11 are aligned in FIG. 17.

Figure 18:
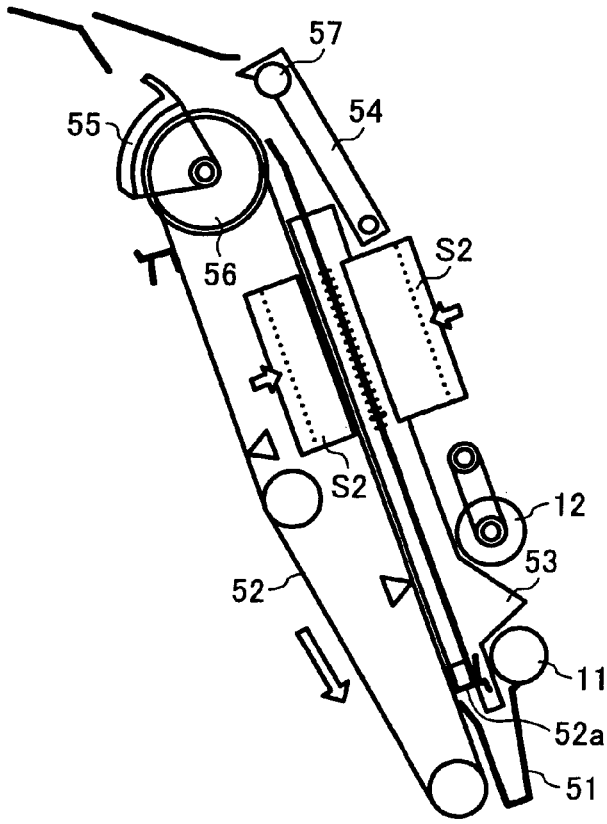
FIG. 18 is a diagram illustrating a state where a sheet bundle is center-stapled in the sheet stapling device.
Figure 20:
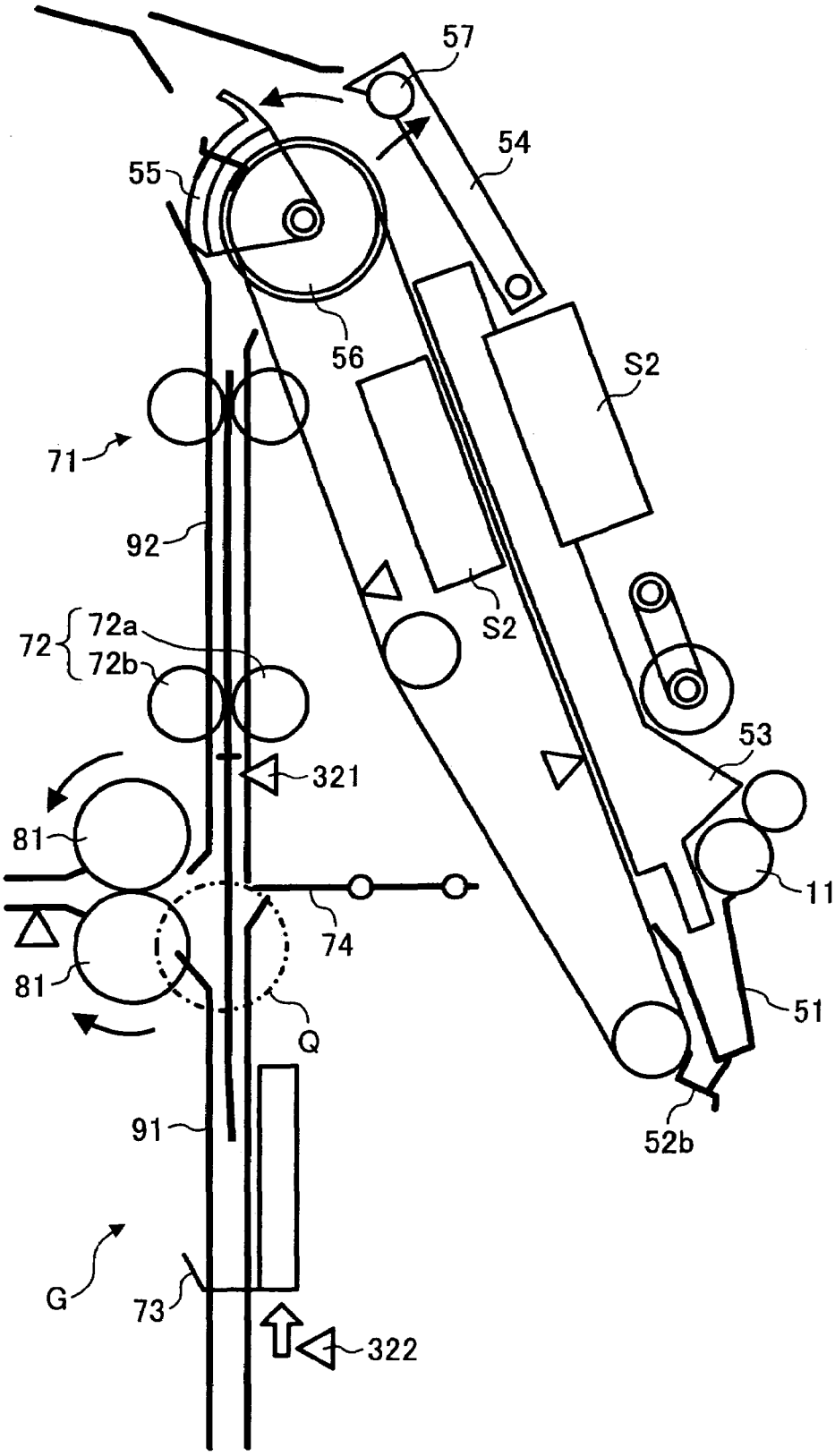
FIG. 20 is a diagram illustrating a state where the sheet bundle is conveyed in a sheet conveying path in the sheet folding device.

Then, a sheet bundle is conveyed by the release claw 52*a* toward the downstream side in the sheet conveying direction by a distance set by a sheet size. Subsequently, the center-stapling staplers S2 perform center-stapling processing on the sheet bundle at its central portion as illustrated in FIG. 18. The center-stapled sheet bundle is conveyed by the release claw 52*a* toward the downstream side by a distance set by a sheet size. The leading edge portion of the sheet bundle is pinched between the release roller 56 and the pressing roller 57. The sheet bundle is further conveyed toward the downstream side by the release claw 52*a* and the release rollers 56 in a sheet conveying path toward the sheet folding device G, which is formed by rotating the branching guide plate 54 and the movable guide 55 as illustrated in FIGS. 19 and 20. The release rollers 56 are provided on the drive shaft for driving the release belt 52 and are driven in synchronism with the release belt 52. The sheet bundle is conveyed to the rear end fence 73 which has been moved from its home position to a position preset according to a sheet size to guide the lower edge surface of the sheet bundle, by the sheet conveying upper and lower rollers 71 and 72. At this time, the release claw 52*a* stops at a position when the other release claw 52*b*, which is disposed opposite to the release claw 52*a* on the outer circumferential surface of the release belt 52, reaches a position adjacent to the end fence 51 illustrated in FIG. 20. The branching guide plate 54 and the movable guide 55 return to their home positions, and prepare for subsequent sheets.

Figure 21:
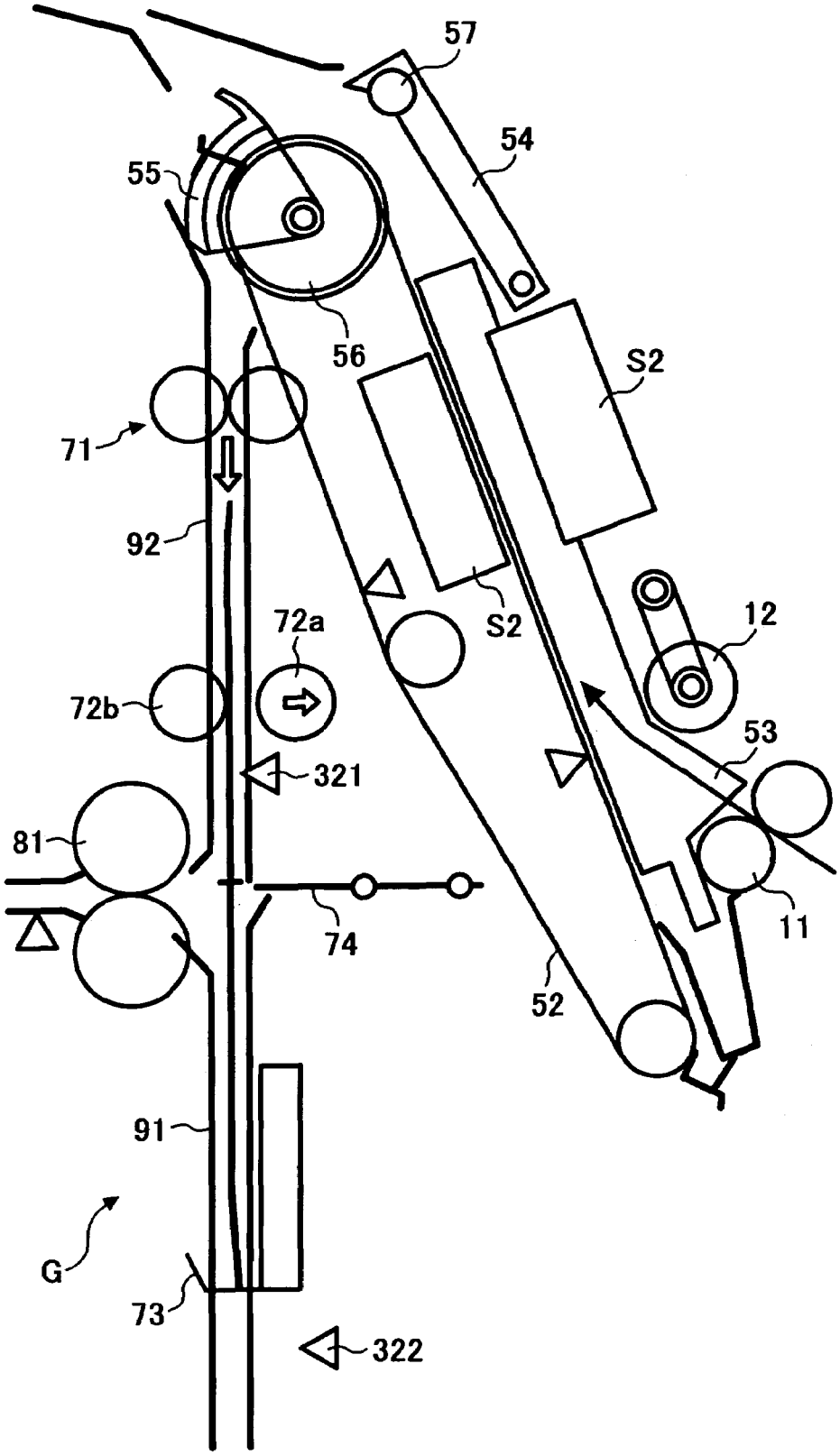
FIG. 21 is a diagram illustrating a state where pressure at a nip part of sheet conveying lower rollers is released, and a leading edge of the sheet bundle falls to a rear end fence in the sheet folding device.
Figure 24:
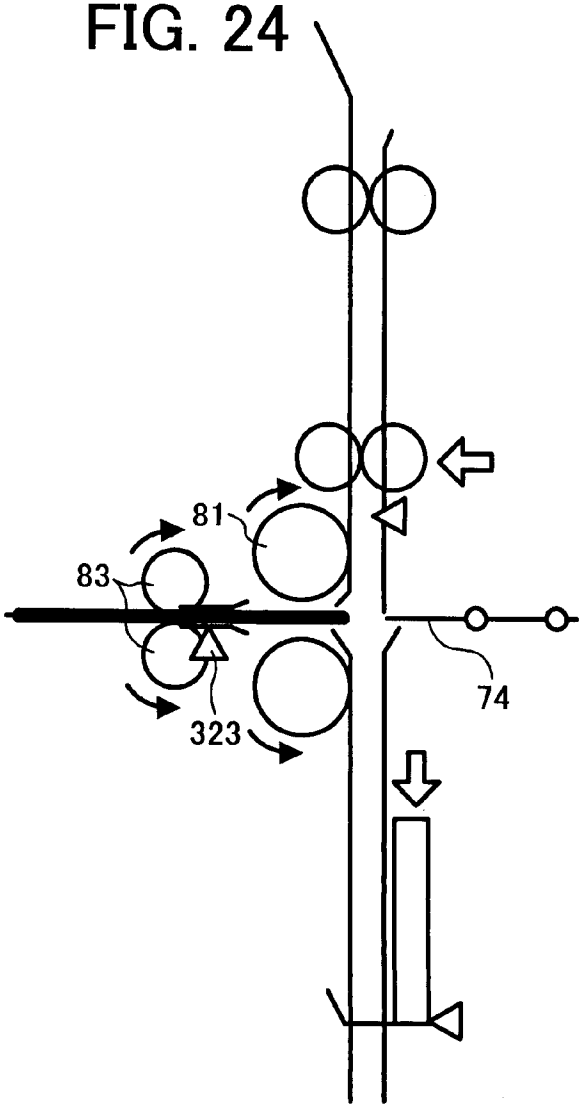
FIG. 24 is a diagram illustrating a state where sheet discharging rollers discharge the center-folded sheet bundle in the sheet folding device.
Figure 23:
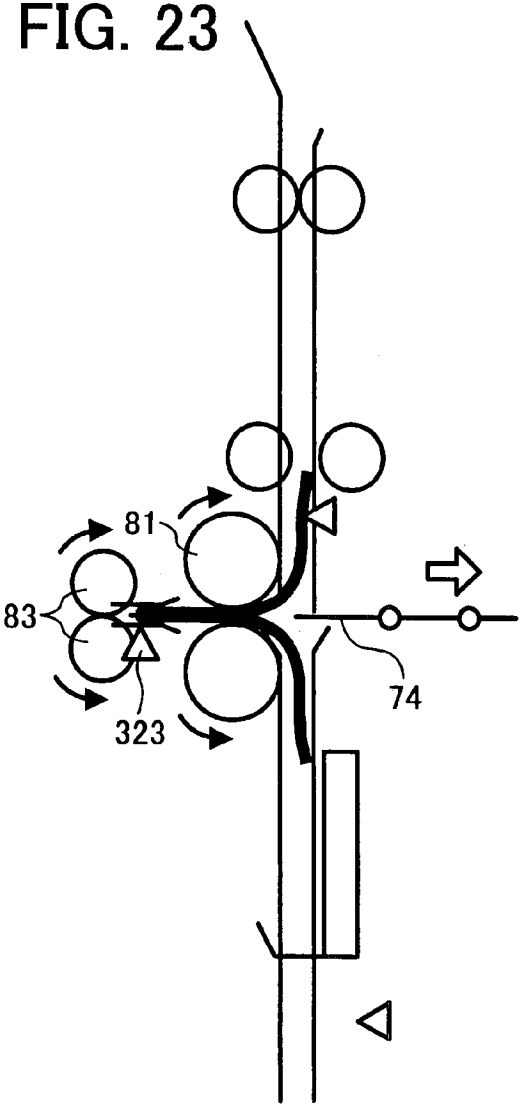
FIG. 23 is a diagram illustrating a state where the folding rollers perform center-folding processing on the sheet bundle in the sheet folding device.
Figure 22:
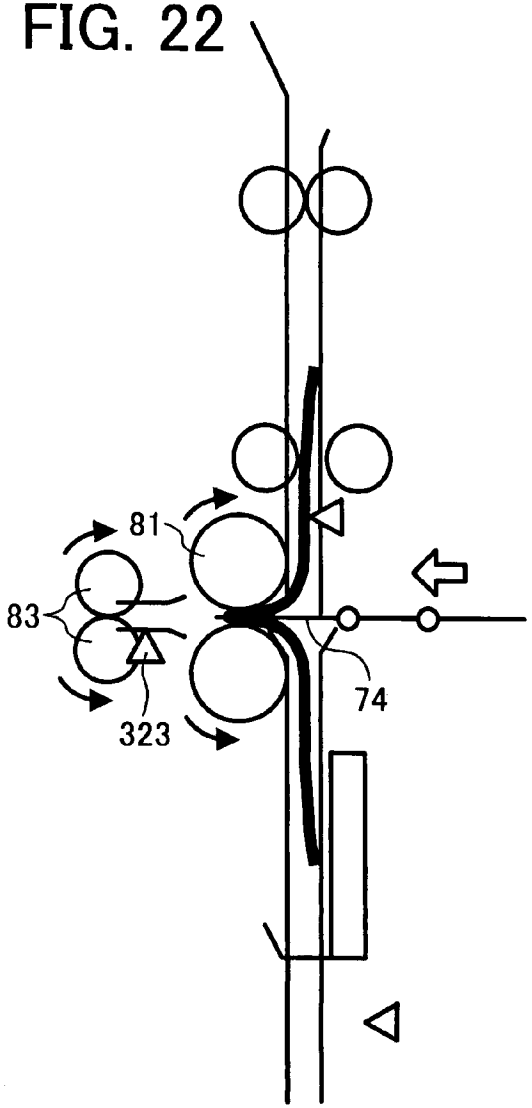
FIG. 22 is a diagram illustrating a state where the folding plate pushes a center-stapled portion of the sheet bundle toward a nip part of folding rollers in the sheet folding device.

After the rear end fence 73 is moved to its standby position and the sheet bundle is conveyed along the sheet conveying guide upper and lower plates 92 and 91 to a predetermined position away from a sheet folding position of the folding plate 74, a driven roller 72*a* of the sheet conveying lower rollers 72 is separated from a drive roller 72*b* of the rollers 72 as shown in FIG. 21, that is, the pressure at the nip part of the rollers 72 is released. Subsequently, the folding plate 74 pushes the center-stapled portion of the sheet bundle toward the nip part of the folding rollers 81 at the sheet folding position as illustrated in FIG. 22. The leading edge of the folding plate 74 contacts the surface of the sheet bundle at an approximately right angle. That is, the folding plate 74 advances toward the nip part of the folding rollers 81 in a direction substantially perpendicular to the sheet conveying direction. The rotating folding rollers 81 perform center-folding processing on the sheet bundle while conveying the sheet bundle with pressure as illustrated in FIG. 23. The center-folded sheet bundle is discharged by the sheet discharging rollers 83 as illustrated in FIG. 24.

Figures 25, 25A:
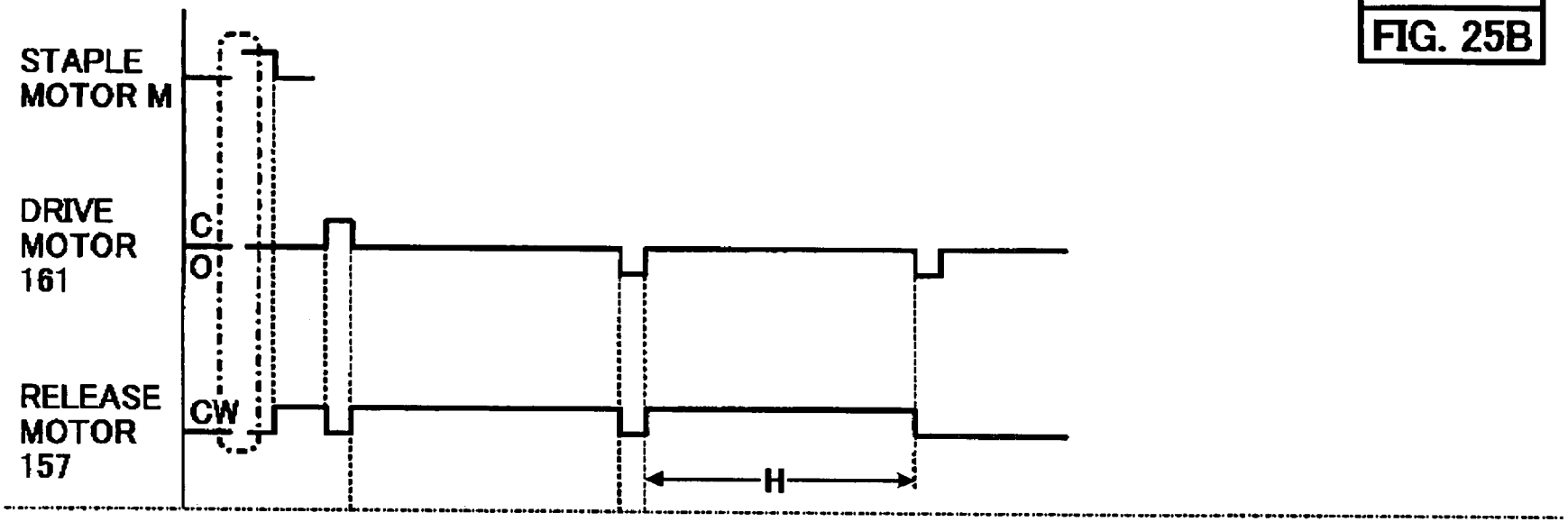
FIG. 25 is a timing chart of a control operation of the control device according to an example embodiment of the present invention.
Figure 25B:
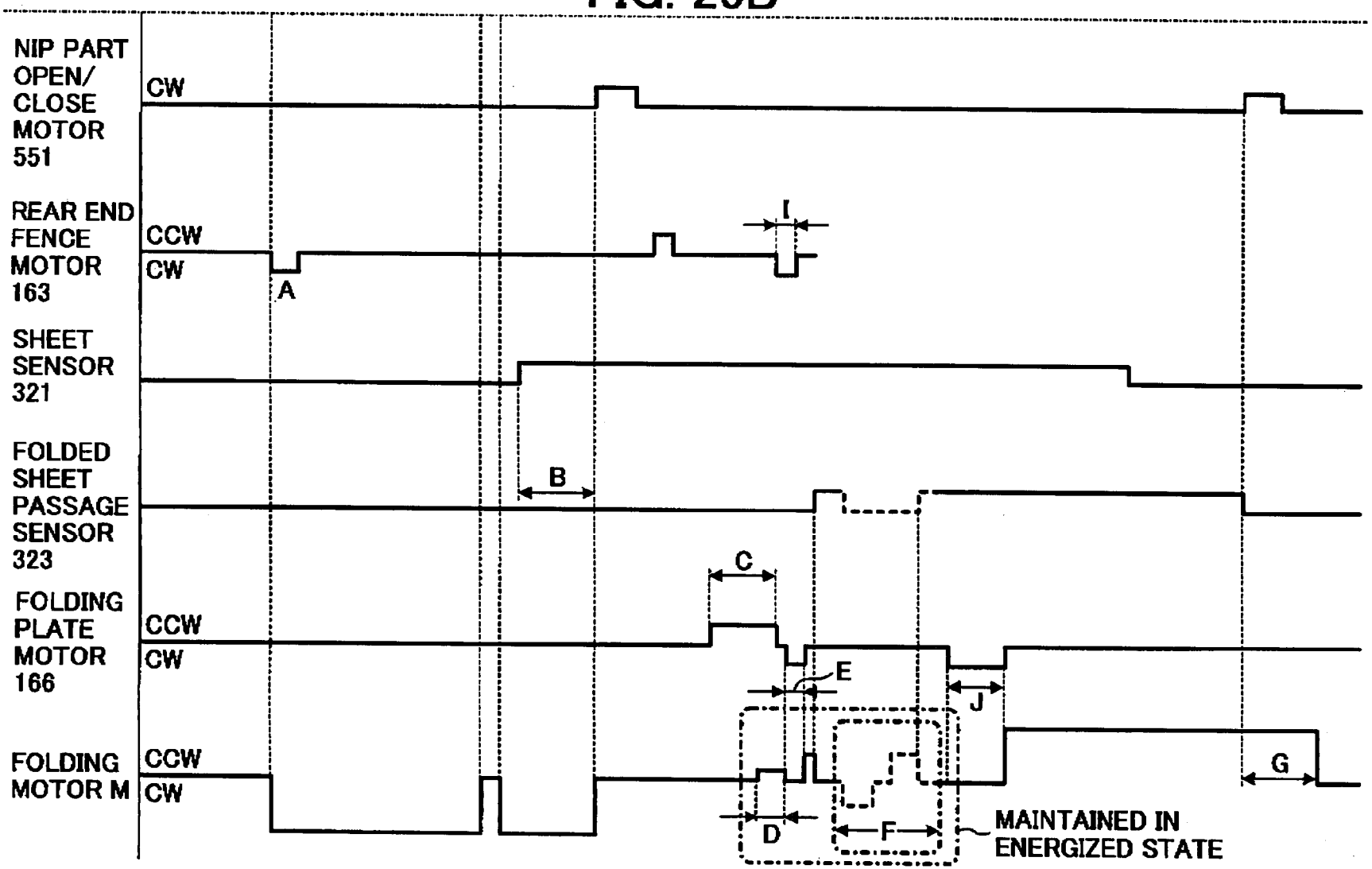

FIG. 25 is a timing chart of a control operation of the control device 350 according to an example embodiment of the present invention. Specifically, the timing chart shows respective drive timings of a staple motor M (not shown) for driving the center-stapling staplers S2, the drive motor 161 (shown in FIGS. 10 through 12) for driving the cam 61, the release motor 157 (shown in FIG. 5) for driving the release belt 52, a nip part open/close motor 551 for opening and closing the nip part of the sheet conveying lower rollers 72 (shown in FIG. 27), the rear end fence motor 163 (shown in FIG. 26) for moving the rear end fence 73, the sheet sensor 321, the folded sheet passage sensor 323, the folding plate motor 166 (shown in FIGS. 13 and 14) for moving the folding plate 74, and a folding motor M (not shown) for driving the sheet conveying upper and lower rollers 71 and 72, the folding rollers 81, and the sheet discharging rollers 83. In FIG. 25, "C" indicates a state where the branching guide plate 54 is closed, that is, the pressing roller 57 provided downstream of the branching guide plate 54 press-contacts the release roller 56 as illustrated in FIG. 19. "O" indicates a state where the branching guide plate 54 is opened, that is, the pressing roller 57 is away from the release roller 56 as illustrated in FIG. 20.

"CW" indicates clockwise rotations of the motor, and "CCW" indicates counter-clockwise rotations of the motor.

With reference to FIG. 25, after the center-stapling staplers S2 are driven by the staple motor M and center-stapling processing is completed, the release motor 157 rotates in the clockwise (CW) direction, and thereby the center-stapled sheet bundle is raised by the release belt 52 and the release claw 52*a*. At this time, the drive motor 161 is driven, and thereby a sheet conveying path is formed along the periphery of the release roller 56 by the branching guide plate 54 and the movable guide 55 (i.e., the branching guide plate 54 is closed). Then, the sheet bundle is directed to the sheet conveying guide upper plate 92. When the leading edge of the sheet bundle reaches the sheet sensor 321 disposed on the sheet conveying guide upper plate 92, the rear end fence motor 163 rotates in the clockwise (CW) direction to drive the rear end fence 73 to move to a standby position lower than the sheet folding position (a period "A" in FIG. 25). If a sheet size is one of A3, B4, A4, and B5, the standby position of the rear end fence 73 is set to be lower than the sheet folding position by about 10 mm. If a sheet size is 12 inch×18 inch, the standby position of the rear end fence 73 is set to be lower than the sheet folding position by about 5 mm. Then, the folding motor M rotates in the clockwise (CW) direction, and thereby the sheet conveying upper and lower rollers 71 and 72 convey the sheet bundle along the sheet conveying guide upper plate 92. Subsequently, the pressure of the pressing roller 57 against the release roller 56 is released by swinging up the branching guide plate 54 (i.e., the branching guide plate 54 is opened), and the release motor 157 and the folding motor M stop rotating. Then, the drive of each of the release motor 157 and the folding motor M is resumed.

When the sheet sensor 321 detects the leading edge of the sheet bundle, the folding motor M rotates for a predetermined drive pulse number. The drive pulse number is set according to a sheet size. By rotating the folding motor M in the clockwise (CW) direction for the predetermined drive pulse number in a period "B" in FIG. 25, the sheet bundle having a sheet size of A3, B4, A4, or B5 is conveyed along the sheet conveying guide upper and lower plates 92 and 91 to a position away (downward) from the sheet folding position by about 7 mm. If the sheet bundle has a sheet size of 12 inch×18 inch, the sheet bundle is conveyed to a position away (downward) from the sheet folding position by about 2 mm. When the leading edge of the sheet bundle is conveyed to such a position, the nip part open/close motor 551 is rotated in the clockwise (CW) direction, and thereby a driven roller 72*a* of the sheet conveying lower rollers 72 is separated from a drive roller 72*b* of the rollers 72 as shown in FIG. 21, that is, the pressure at the nip part of the rollers 72 is released. By doing so, the sheet bundle falls freely, and the sheet bundle abuts against the rear end fence 73 which has been moved to the standby position located downward from the sheet folding position, and is aligned.

Then, the rear end fence motor 163 rotates in the counter-clockwise (CCW) direction to move the rear end fence 73 from the standby position such that the sheet bundle moves to the sheet folding position of the folding plate 74. After a predetermined time has elapsed, the folding plate 74 advances toward the sheet bundle by rotating the folding plate motor 166 in the counter-clockwise (CCW) direction for a predetermined time in a period "C" in FIG. 25. If the sheet bundle includes 2 to 5 sheets, the folding plate 74 advances to a position about 2.8 mm before the nip part of the folding rollers 81. If the sheet bundle includes 6 to 25 sheets, the folding plate 74 advances to a position about 0.5 mm before the nip part of the folding rollers 81. Further, the folding motor M rotates in the counter-clockwise (CCW) direction to rotate the folding rollers 81 in a period "D" in FIG. 25, thereby folding the sheet bundle at the nip part of the folding rollers 81. Then, the folding plate 74 is retracted by rotating the folding plate motor 166 in the clockwise (CW) direction for a predetermined time in a period "E" in FIG. 25.

After the folded sheet passage sensor 323 detects the leading edge of the sheet bundle, the folding rollers 81 are repeatedly rotated in forward and reverse directions to fold the sheet bundle securely according to the number of sheets (if necessary) in a period "F" in FIG. 25. Then, the folded sheet bundle is discharged and stacked onto the lower tray 203 by the sheet discharging rollers 83 while rotating the folding motor M in the counter-clockwise (CCW) direction. At that time, the driven roller 72*a* of the sheet conveying lower rollers 72 is brought into contact with the drive roller 72*b* of the rollers 72 as shown in FIG. 24 by rotating the nip part open/close motor 551 in the clockwise (CW) direction, and the sheet conveying lower rollers 72 prepare for a conveyance of a subsequent sheet bundle. In a period "G" in FIG. 25, the folding motor M is further rotated by one counter-clockwise rotation to ensure the discharge of the sheet bundle. In a period "H" in FIG. 25, the release belt 52 is moved to its standby position by rotating the release motor 157 in the clockwise (CW) direction. In a period "I" in FIG. 25, the rear end fence 73 is returned to its standby position by rotating the rear end fence motor 163 in the clockwise (CW) direction. In a period "J" in FIG. 25, the folding plate 74 is returned to its home position by rotating the folding plate motor 166 in the clockwise (CW) direction.

Figure 26B:
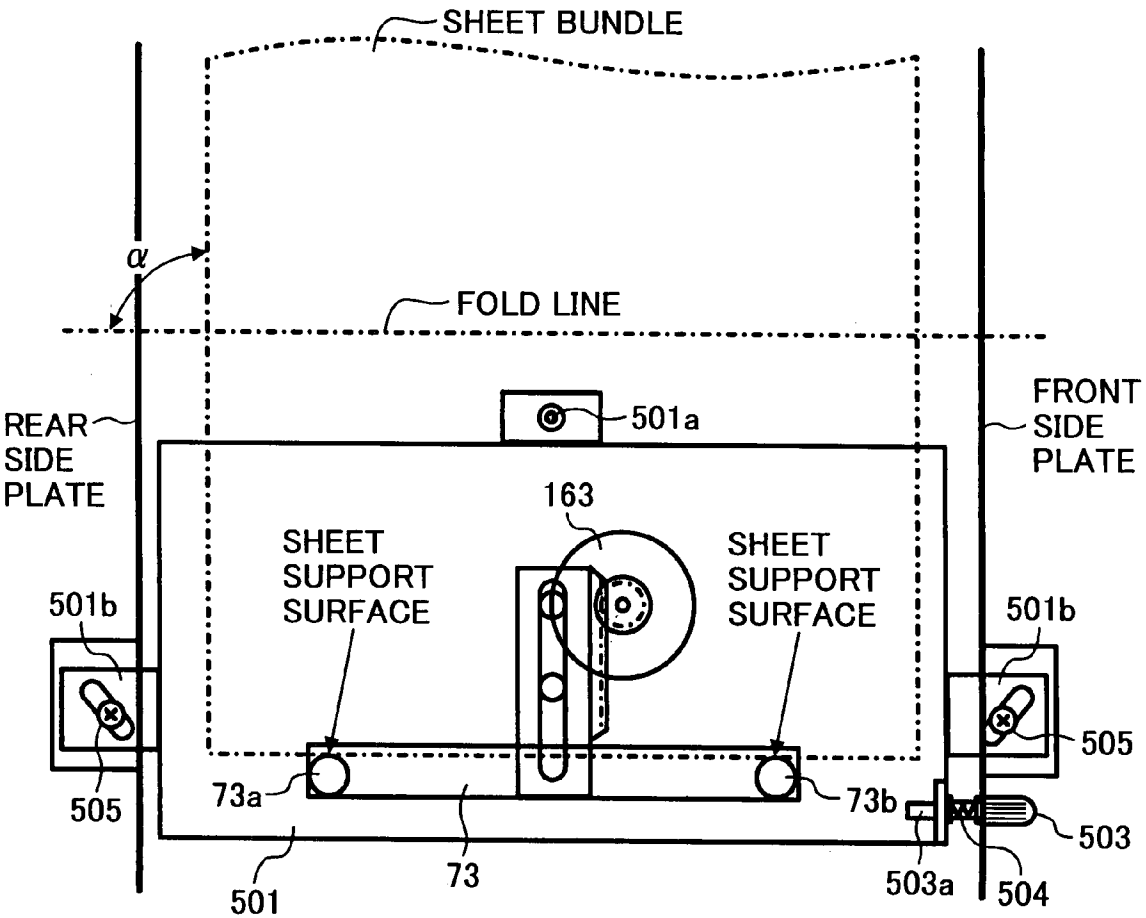
FIG. 26B is a front view of the drive mechanism of the rear end fence of FIG. 26A.
Figure 26A:
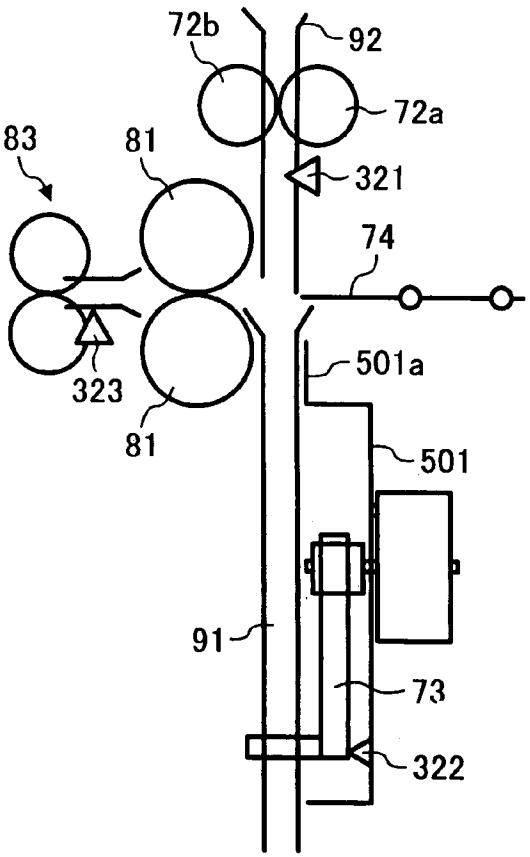
FIG. 26A is a side view of a drive mechanism of the rear end fence of the sheet folding device.

FIG. 26A is a side view of a drive mechanism of the rear end fence 73 of the sheet folding device G. FIG. 26B is a front view of the drive mechanism of the rear end fence 73 of FIG. 26A. The rear end fence 73 has a sheet support surface for supporting and aligning the sheet bundle conveyed along the sheet conveying guide upper and lower plates 92 and 91. The rear end fence 73 is configured to be raised and lowered by the rear end fence motor 163, and to support the sheet bundle at two supporting points 73*a* and 73*b*. As described above, the rear end fence motor 163 is formed from, for example, a stepping motor (pulse motor), and the movement of the rear end fence motor 163 is controlled by setting and counting pulse numbers. In this example embodiment, the two supporting points 73*a* and 73*b* are provided at positions inward each by about 10 mm from positions corresponding to both edges of a B5 sized sheet placed in portrait orientation, which is a minimum sized sheet that can be subjected to center-folding processing. The rear end fence 73 and the rear end fence motor 163 are attached to a base 501. The base 501 is rotatably supported by the sheet conveying guide lower plate 91 about a rotation support point 501*a*. An adjustment screw 503 and a compression spring 501 are provided at a lower end portion of the base 501 on a right side in FIG. 26B. The adjustment screw 503 is connected to the base 501 with a screw portion 503*a* from the outer side of a front side plate via the compression spring 504. The compression spring 504 applies a bias force of rotating the base 501 toward a rear side plate. By rotating the adjustment screw 503 rightward, the base 501 is rotated toward the front side plate. By rotating the adjustment screw 503 leftward, the base 501 is rotated toward the rear side plate by the action of the compression spring 504.

Base fixing portions 501*b* of the base 501 are fixed to the front and rear side plates with fixing screws 505, respectively, after adjusting the position of the base 501 with the adjustment screw 503 such that an angle formed between the fold line of the sheet bundle supported by the rear end fence 73 and the edge surface of the sheet bundle supported by the two supporting points 73*a* and 73*b* is 0 degree (i.e., in a parallel relation). If necessary, a cam may be used for increasing the efficiency of the adjustment operation. Alternatively, the position of the base 501 may be adjusted such that an angle $\alpha$ formed between the fold line of the sheet bundle supported by the rear end fence 73 and the edge surface of the sheet bundle in parallel to the sheet conveying direction is 90 degrees. The position of the base 501 is usually adjusted before shipping sheet post-processing apparatuses from a manufacturing factory.

Figure 27:
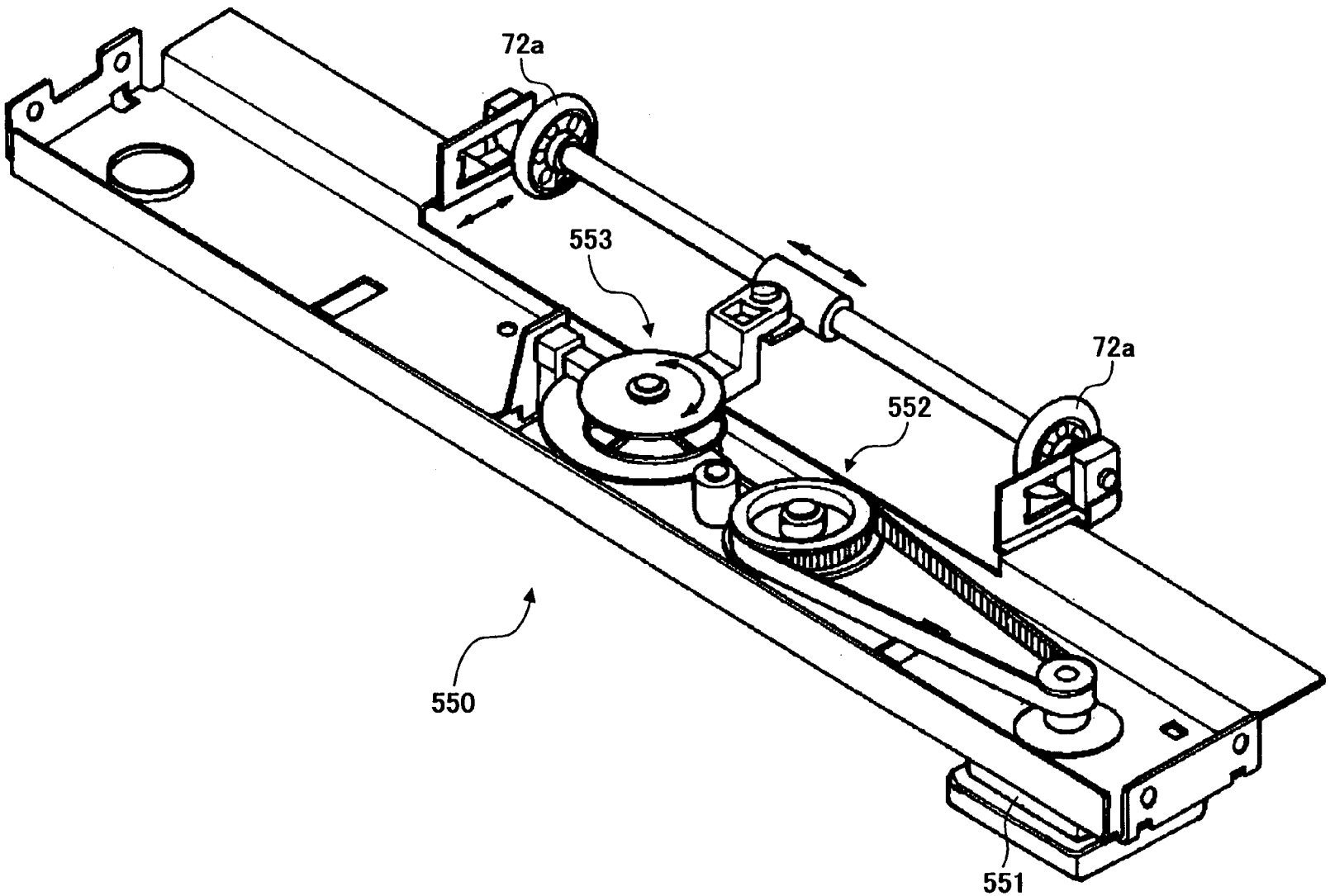
FIG. 27 is a perspective view of a drive mechanism including a nip part open/close motor.

FIG. 27 is a perspective view of a drive mechanism 550 including the nip part open/close motor 551. With the drive mechanism 550, the driven roller 72*a* of the sheet conveying lower rollers 72 is retracted from and returned to the sheet conveying guide upper plate 92, thereby opening and closing the nip part between the drive roller 72*b* and the driven roller 72*a* of the sheet conveying lower rollers 72. In the drive mechanism 550, the drive of the nip part open/close motor 551 is converted to the reciprocating motions of the driven roller 72*a* by a cam mechanism 553 via a reduction gear mechanism 552.

As described above, according to the embodiment of the present invention, a sheet bundle is conveyed to the sheet folding position by the rear end fence 73. Further, the skew of the sheet bundle is corrected due to a gravitational free fall to the rear end fence 73, and during a period when the sheet bundle is supported and moved to the sheet folding position. Therefore, the quality of the folded sheet bundle as a booklet can be enhanced.

In the above-described embodiment of the present invention, the pressure of the sheet conveying lower rollers 72 is released after the leading edge of the sheet bundle is detected by the sheet sensor 321 and reaches the position adjacent to the sheet folding position. Even if the sheet bundle is stuck in a sheet conveying path and does not reach the rear end fence 73, the rear end fence 73 is configured to move to the sheet folding position to correct the skew of the sheet bundle. Therefore, the sheet bundle can be folded properly without loss of folding quality.

Further, in the above-described embodiment of the present invention, the sheet folding device G may fold a single sheet as well as a stapled sheet bundle. The rear end fence 73 acts as a sheet position adjusting unit that supports and moves a sheet or a sheet bundle and that adjusts the sheet or the sheet bundle to the sheet folding position.

Figure 28:
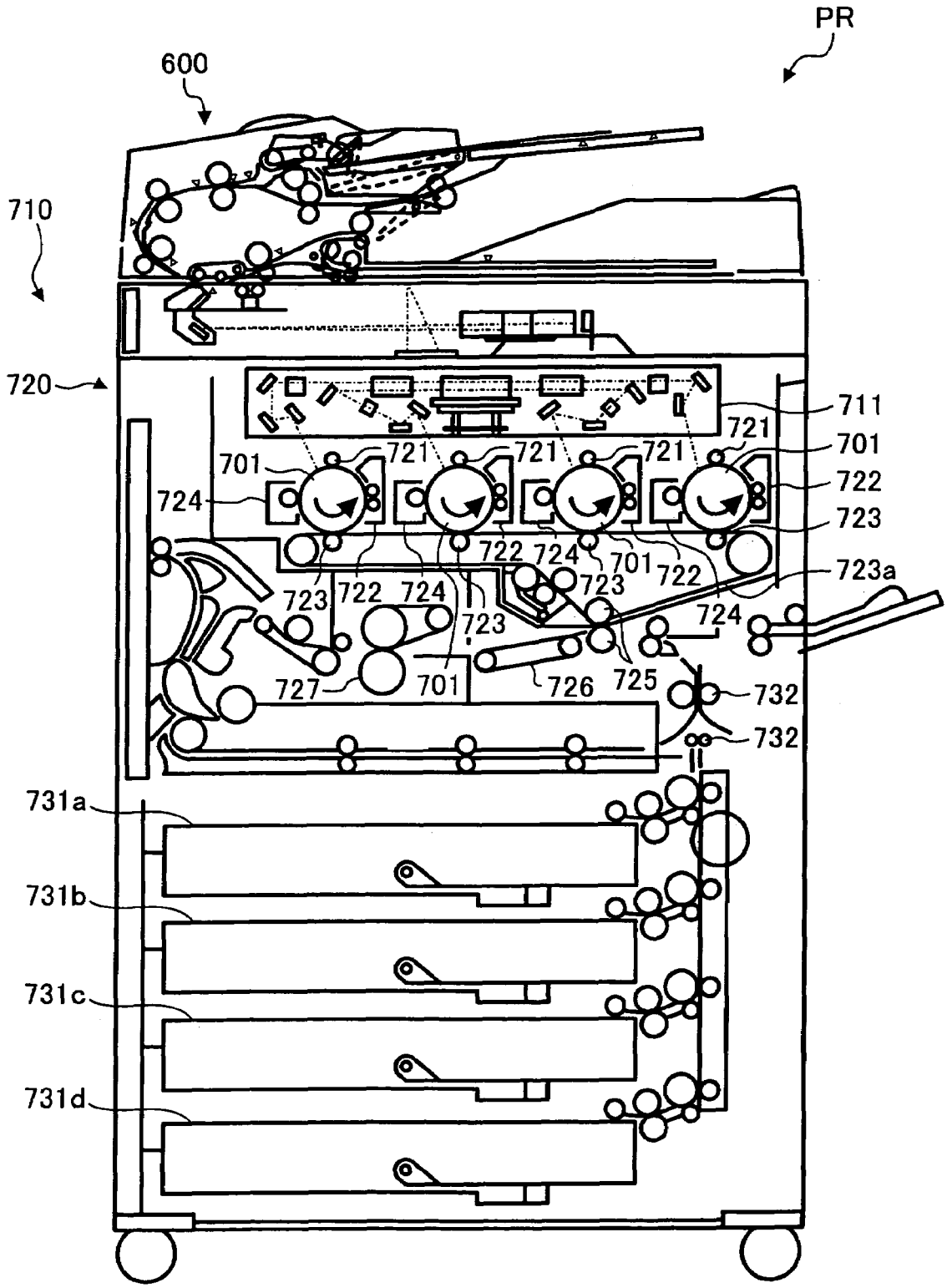
FIG. 28 is a schematic sectional view of the image forming apparatus according to an example embodiment of the present invention, which is connected with the sheet post-processing apparatus of FIG. 1.

FIG. 28 is a schematic sectional view of the image forming apparatus PR according to an example embodiment of the present invention, which is connected with the sheet post-processing apparatus PD of FIG. 1. The image forming apparatus PR, such as a copying machine, a printer, a facsimile, or other similar image forming apparatuses, includes an auto document feeder 600, a main body 710 including an image forming device 720, and a sheet feeding unit 731. In place of a color image forming apparatus, a monochrome image forming apparatus may be used as the image forming apparatus PR.

As illustrated in FIG. 28, the image forming device 720 includes the so-called tandem-type, four-image forming units that form images of different colors. Each of the image forming units includes an image carrier 701 formed from an amorphous metal, such as photoconductive amorphous silicon and amorphous selenium, and organic compounds, such as bisazo pigments, and phthalocyanine pigments. In view of environmental issues and post-processing after use, it is preferable that the image carrier 701 is formed from organic compounds. Each of the image forming units further includes a charging roller 721, a developing device 722, a primary transfer device 723, and a cleaning device 724, all of which are disposed around the image carrier 701. The image forming device 720 further includes a fixing device 727. The configurations and operations of the elements of each of the four image forming units are substantially the same except for the color of toner used therein.

In place of the charging roller 721 acting as a charging device, a corona-type charging device, a roller-type charging device, a brush-type charging device, or a blade-type charging device may be employed. A voltage is applied to a gap between the charging roller 721 and the image carrier 701, thereby generating a corona discharge between the charging roller 721 and the image carrier 701, so that the surface of the image carrier 701 is uniformly charged.

The image forming device 720 further includes an exposing device 711 that irradiates the surface of each of the image carriers 701 with laser light based on image data of an original document read by an image reading device (not shown) and image data transmitted from an outside device such as a personal computer (not shown). Thereby, an electrostatic latent image is formed on the surface of each of the image carriers 701.

The developing device 722 develops the electrostatic latent image with toner, and forms a toner image on the surface of the image carrier 701. The toner images of different colors, which have been formed on the image carriers 701, are sequentially transferred to an intermediate transfer belt 723*a*, while being superimposed on one another by the respective primary transfer devices 723. Subsequently, a superimposed color image is transferred from the intermediate transfer belt 723*a* to a recording sheet by a secondary transfer device 725. After the toner image is transferred from the image carrier 701 to the intermediate transfer belt 723*a*, the cleaning device 724 removes residual toner remaining on the image carrier 701.

The sheet feeding unit 731 disposed below the image forming device 720, includes a plurality of sheet feeding cassettes 731*a*, 731*b*, 731*c*, and 731*d* that accommodate recording sheets therein. The recording sheet fed out from one of the sheet feeding cassettes 73 1*a*, 731*b*, 731*c*, and 731*d* is conveyed to the secondary transfer device 725 by sheet conveying rollers 732.

The recording sheet, to which the color image is transferred from the intermediate transfer belt 723*a*, is conveyed to the fixing device 727 by a conveyor belt 726. The color image is fixed onto the recording sheet by heat and pressure while the recording sheet passes through the fixing device 727. Subsequently, the recording sheet having a fixed color image is conveyed to the sheet post-processing apparatus PD.

The previously described device may also be described in terms of a method for folding one of a sheet and a sheet bundle in a sheet processing apparatus. The method includes conveying the one of a sheet and a sheet bundle with pressure by a sheet conveying unit toward a sheet position adjusting unit; moving the sheet position adjusting unit to a standby position located downstream of a folding position of a folding plate in a sheet conveying direction; releasing the pressure of the sheet conveying unit; adjusting the one of a sheet and a sheet bundle to the folding position by supporting and moving the one of a sheet and a sheet bundle; advancing the folding plate toward a nip part of folding rollers in a direction substantially perpendicular to the sheet conveying direction; putting a fold line in the one of a sheet and a sheet bundle conveyed along a sheet conveying path at the folding position; and folding the one of a sheet and a sheet bundle by pinching a portion of the one of a sheet and a sheet bundle around the fold line at the nip part. Optionally, the method also includes at least one of stapling the sheet bundle, sorting sheets, and punching holes in the sheet. As noted previously, one or more of these steps may be controlled by the CPU 360 via the I/O interface 370.

The present invention has been described with respect to the exemplary embodiments illustrated in the figures. However, the present invention is not limited to these embodiments and may be practiced otherwise.

Numerous additional modifications and variations of the present invention are possible in light of the above teachings. It is therefore to be understood that within the scope of the appended claims, the present invention may be practiced otherwise than as specifically described herein.

What is claimed:

1. A method of forming an image, comprising:

forming an image; and folding one of a sheet and a sheet bundle in a sheet processing apparatus, the step of folding comprising, conveying said one of a sheet and a sheet bundle with pressure by a sheet conveying unit toward a sheet position adjusting unit;

moving the sheet position adjusting unit to a standby position located downstream of a folding position of a folding member in a sheet conveying direction;

releasing the pressure of the sheet conveying unit;

adjusting said one of a sheet and a sheet bundle, after the releasing the pressure, from the standby position to the folding position by supporting and moving said one of a sheet and a sheet bundle;

advancing the folding member toward a nip part of folding rollers in a direction substantially perpendicular to the sheet conveying direction;

putting a fold line in said one of a sheet and a sheet bundle conveyed along a sheet conveying path at the folding position; and folding said one of a sheet and a sheet bundle by pinching a portion of said one of a sheet and a sheet bundle around the fold line at the nip part.

2. The method for folding one of a sheet and a sheet bundle in a sheet processing apparatus according to claim 1, wherein the conveying step includes conveying by sheet conveying rollers.

3. The method for folding one of a sheet and a sheet bundle in a sheet processing apparatus according to claim 2, wherein the releasing the pressure step includes moving a first sheet conveying roller away from a second sheet conveying roller.

4. A method for folding one of a sheet and a sheet bundle in a sheet processing apparatus, comprising:

conveying said one of a sheet and a sheet bundle with pressure by a sheet conveying unit toward a sheet position adjusting unit;

moving the sheet position adjusting unit to a standby position located downstream of a folding position of a folding member in a sheet conveying direction;

releasing the pressure of the sheet conveying unit;

adjusting said one of a sheet and a sheet bundle, after the releasing the pressure, from the standby position to the folding position by supporting and moving said one of a sheet and a sheet bundle;

advancing the folding member toward a nip part of folding rollers in a direction substantially perpendicular to the sheet conveying direction;

putting a fold line in said one of a sheet and a sheet bundle conveyed along a sheet conveying path at the folding position;

folding said one of a sheet and a sheet bundle by pinching a portion of said one of a sheet and a sheet bundle around the fold line at the nip part; and at least one of stapling said sheet bundle, sorting sheets, and punching holes in said sheet.

5. The method for folding one of a sheet and a sheet bundle in a sheet processing apparatus according to claim 4, wherein the conveying step includes conveying by sheet conveying rollers.

6. The method for folding one of a sheet and a sheet bundle in a sheet processing apparatus according to claim 5, wherein the releasing the pressure step includes moving a first sheet conveying roller away from a second sheet conveying roller.

7. A sheet folding device, comprising:

a folding member configured to put a fold line in one of a sheet and a sheet bundle conveyed along a sheet conveying path at a folding position;

folding rollers configured to fold said one of a sheet and a sheet bundle by pinching a portion of said one of a sheet and a sheet bundle around the fold line at a nip part between the folding rollers, the folding member configured to advance toward the nip part in a direction substantially perpendicular to a sheet conveying direction;

a sheet position adjusting unit configured to support and move said one of a sheet and a sheet bundle and to adjust said one of a sheet and a sheet bundle to the folding position of the folding member;

a sheet conveying unit configured to convey said one of a sheet and a sheet bundle with pressure toward the sheet position adjusting unit and configured to release the pressure before the one of a sheet and a sheet bundle contact the sheet position adjusting unit;

a drive device configured to move the sheet position adjusting unit to a standby position located downstream of the folding position of the folding member in the sheet conveying direction, and to move the sheet position adjusting unit from the standby position such that said one of a sheet and a sheet bundle supported by the sheet position adjusting unit moves to the folding position of the folding member after the pressure of the sheet conveying unit is release; and a control device configured to control the sheet conveying unit to release the pressure after said one of a sheet and a sheet bundle conveyed by the sheet conveying unit reaches the folding position of the folding member, wherein an interval is formed in the sheet conveying direction between a leading edge of said one of a sheet and a sheet bundle and the sheet position adjusting unit when the control device controls the sheet conveying unit to release the pressure, and said one of a sheet and a sheet bundle is aligned by contacting the sheet position adjusting unit due to a free fall.

8. The sheet folding device according to claim 7, wherein the sheet conveying unit conveys said one of a sheet and a sheet bundle along the sheet conveying path formed in a gravitational direction.

9. The sheet folding device according to claim 7, wherein a distance of the free fall of said one of a sheet and a sheet bundle is set according to a sheet size.

10. The sheet folding device according to claim 7, wherein the drive device comprises:

a pulse motor.

11. The sheet folding device according to claim 7, wherein the sheet conveying unit includes sheet conveying rollers.

12. The sheet folding device according to claim 11, wherein a first sheet conveying roller moves away from a second sheet conveying roller to release the pressure of the sheet conveying unit.

13. A sheet processing apparatus, comprising:

a sheet folding device configured to fold one of a sheet and a sheet bundle, comprising, a folding member configured to put a fold line in said one of a sheet and a sheet bundle conveyed along a sheet conveying path at a folding position;

folding rollers configured to fold said one of a sheet and a sheet bundle by pinching a portion of said one of a sheet and a sheet bundle around the fold line at a nip part between the folding rollers, the folding member configured to advance toward the nip part in a direction substantially perpendicular to a sheet conveying direction;

a sheet position adjusting unit configured to support and move said one of a sheet and a sheet bundle and to adjust said one of a sheet and a sheet bundle to the folding position of the folding member;

a sheet conveying unit configured to convey said one of a sheet and a sheet bundle with pressure toward the sheet position adjusting unit and configured to release the pressure before the one of a sheet and a sheet bundle contact the sheet position adjusting unit;

a drive device configured to move the sheet position adjusting unit to a standby position located downstream of the folding position of the folding member in the sheet conveying direction, and to move the sheet position adjusting unit from the standby position such that said one of a sheet and a sheet bundle supported by the sheet position adjusting unit moves to the folding position of the folding member after the pressure of the sheet conveying unit is released; and a control device configured to control the sheet conveying unit to release the pressure after said one of a sheet and a sheet bundle conveyed by the sheet conveying unit reaches the folding position of the folding member, wherein an interval is formed in the sheet conveying direction between a leading edge of said one of a sheet and a sheet bundle and the sheet position adjusting unit when the control device controls the sheet conveying unit to release the pressure, and said one of a sheet and a sheet bundle is aligned by contacting the sheet position adjusting unit due to a free fall; and, at least one of a sheet stapling device configured to staple said sheet bundle, a sheet sorting device configured to sort sheets, and a sheet punching device configured to punch holes in said sheet.

14. The sheet processing apparatus according to claim 13, wherein the sheet conveying unit conveys said one of a sheet and a sheet bundle along the sheet conveying path formed in a gravitational direction.

15. The sheet processing apparatus according to claim 13, wherein a distance of the free fall of said one of a sheet and a sheet bundle is set according to a sheet size.

16. The sheet processing apparatus according to claim 13, wherein the drive device comprises:

a pulse motor.

17. The sheet processing apparatus according to claim 13, wherein the sheet conveying unit includes sheet conveying rollers.

18. The sheet processing apparatus according to claim 17, wherein a first sheet conveying roller moves away from a second sheet conveying roller to release the pressure of the sheet conveying unit.

19. An image forming system, comprising:

an image forming device; and a sheet folding device configured to fold one of a sheet and a sheet bundle having an image formed by the image forming device, the sheet folding device comprising, a folding member configured to put a fold line in said one of a sheet and a sheet bundle conveyed along a sheet conveying path at a folding position;

folding rollers configured to fold said one of a sheet and a sheet bundle by pinching a portion of said one of a sheet and a sheet bundle around the fold line at a nip part between the folding rollers, the folding member configured to advance toward the nip part in a direction substantially perpendicular to a sheet conveying direction;

a sheet position adjusting unit configured to support and move said one of a sheet and a sheet bundle and to adjust said one of a sheet and a sheet bundle to the folding position of the folding member;

a sheet conveying unit configured to convey said one of a sheet and a sheet bundle with pressure toward the sheet position adjusting unit and configured to release the pressure before the one of a sheet and a sheet bundle contact the sheet position adjusting unit;

a drive device configured to move the sheet position adjusting unit to a standby position located downstream of the folding position of the folding member in the sheet conveying direction, and to move the sheet position adjusting unit from the standby position such that said one of a sheet and a sheet bundle supported by the sheet position adjusting unit moves to the folding position of the folding member after the pressure of the sheet conveying unit is released; and a control device configured to control the sheet conveying unit to release the pressure after said one of a sheet and a sheet bundle conveyed by the sheet conveying unit reaches the folding position of the folding member, wherein an interval is formed in the sheet conveying direction between a leading edge of said one of a sheet and a sheet bundle and the sheet position adjusting unit when the control device controls the sheet conveying unit to release the pressure, and said one of a sheet and a sheet bundle is aligned by contacting the sheet position adjusting unit due to a free fall.

20. The image forming system according to claim 19, wherein the sheet conveying unit conveys said one of a sheet and a sheet bundle along the sheet conveying path formed in a gravitational direction.

21. The image forming system according to claim 19, wherein a distance of the free fall of said one of a sheet and a sheet bundle is set according to a sheet size.

22. The image forming system according to claim 19, wherein the drive device comprises:

a pulse motor.

23. The image forming system according to claim 19, wherein the sheet conveying unit includes sheet conveying rollers.

24. The image forming system according to claim 23, wherein a first sheet conveying roller moves away from a second sheet conveying roller to release the pressure of the sheet conveying unit.

25. A sheet processing apparatus, comprising:

a sheet folding device configured to fold one of a sheet and a sheet bundle, comprising, means for putting a fold line in said one of a sheet and a sheet bundle conveyed along a sheet conveying path at a folding position, means for folding said one of a sheet and a sheet bundle by pinching a portion of said one of a sheet and a sheet bundle around the fold line at a nip part between the means for folding, the means for putting configured to advance toward the nip part in a direction substantially perpendicular to a sheet conveying direction, means for adjusting said one of a sheet and a sheet bundle to the folding position of the means for putting by supporting and moving said one of a sheet and a sheet bundle, means for conveying said one of a sheet and a sheet bundle with pressure toward the means for adjusting, means for releasing the pressure before the one of a sheet and a sheet bundle contact the means for adjusting, means for moving the means for adjusting to a standby position located downstream of the folding position of the means for putting in the sheet conveying direction, and for moving the means for adjusting from the standby position such that said one of a sheet and a sheet bundle supported by the means for adjusting moves to the folding position of the folding member after the pressure of the means for conveying is released, and means for controlling the means for releasing to release the pressure after said one of a sheet and a sheet bundle conveyed by the means for conveying reaches the folding position of the folding member, wherein an interval is formed in the sheet conveying direction between a leading edge of said one of a sheet and a sheet bundle and the means for adjusting when the means for releasing releases the pressure, and said one of a sheet and a sheet bundle is aligned by contacting the means for adjusting due to a free fall; and, at least one of means for stapling said sheet bundle, means for sorting sheets, and means for punching holes in said sheet.

26. The sheet processing apparatus according to claim 25, wherein the means for conveying includes sheet conveying rollers.

27. The sheet processing apparatus according to claim 26, wherein a first sheet conveying roller moves away from a second sheet conveying roller to release the pressure of the means for conveying.

28. An image forming system, comprising:

means for forming an image; and a sheet folding device configured to fold one of a sheet and a sheet bundle having the image formed by the means for forming, the sheet folding device comprising, means for putting a fold line in said one of a sheet and a sheet bundle conveyed along a sheet conveying path at a folding position, means for folding said one of a sheet and a sheet bundle by pinching a portion of said one of a sheet and a sheet bundle around the fold line at a nip part between the means for folding, the means for putting configured to advance toward the nip part in a direction substantially perpendicular to a sheet conveying direction, means for adjusting said one of a sheet and a sheet bundle to the folding position of the means for putting by supporting and moving said one of a sheet and a sheet bundle, means for conveying said one of a sheet and a sheet bundle with pressure toward the means for adjusting, means for releasing the pressure before the one of a sheet and a sheet bundle contact the means for adjusting, means for moving the means for adjusting to a standby position located downstream of the folding position of the means for putting in the sheet conveying direction, and for moving the means for adjusting from the standby position such that said one of a sheet and a sheet bundle supported by the means for adjusting moves to the folding position of the folding member after the pressure of the means for conveying is released, and means for controlling the means for releasing to release the pressure after said one of a sheet and a sheet bundle conveyed by the means for conveying reaches the folding position of the folding member, wherein an interval is formed in the sheet conveying direction between a leading edge of said one of a sheet and a sheet bundle and the means for adjusting when the means for releasing releases the pressure, and said one of a sheet and a sheet bundle is aligned by contacting the means for adjusting due to a free fall.

29. The image forming system according to claim 28, wherein the means for conveying includes sheet conveying rollers.

30. The image forming system according to claim 29, wherein a first sheet conveying roller moves away from a second sheet conveying roller to release the pressure of the means for conveying.

* * * * *